US012624692B2

(12) United States Patent
Claywell et al.

(10) Patent No.: US 12,624,692 B2
(45) Date of Patent: May 12, 2026

(54) PUMP SEALING MEMBER GROOVE WITH DRAIN FOR A VEHICLE

(71) Applicant: GM GLOBAL TECHNOLOGY OPERATIONS LLC, Detroit, MI (US)

(72) Inventors: Mark Claywell, Birmingham, MI (US); Sean Michael McGowan, Northville, MI (US); Bryan K. Pryor, Clarkston, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 330 days.

(21) Appl. No.: 18/517,782

(22) Filed: Nov. 22, 2023

(65) Prior Publication Data

US 2025/0163909 A1 May 22, 2025

(51) Int. Cl.
*F04B 53/04* (2006.01)
*F04B 53/16* (2006.01)

(52) U.S. Cl.
CPC ..... *F04B 53/04* (2013.01); *F04B 53/16* (2013.01)

(58) Field of Classification Search
CPC ..... F04B 53/00; F04B 53/04; F04B 53/16; F04C 15/00; F04C 2240/30
See application file for complete search history.

(56) References Cited

U.S. PATENT DOCUMENTS 4,071,273 A * 1/1978 Hack ..... B62D 25/18 239/288.5
4,700,981 A * 10/1987 Seyler ..... F16B 5/10 29/523
5,725,272 A * 3/1998 Jones ..... B62D 25/07 277/933
6,561,756 B2 * 5/2003 Ozawa ..... F04D 29/049 415/230
6,945,759 B2 * 9/2005 Henderson ..... F01C 21/10 418/104
8,795,876 B2 * 8/2014 Thomas ..... B60L 50/66 429/99
2002/0136633 A1 * 9/2002 Ozawa ..... F01P 5/10 415/168.2

FOREIGN PATENT DOCUMENTS

| | | | |
|---|---|---|---|
| DE | 2335054 | A | 7/1973 |
| DE | 602004002112 | T2 | 3/2007 |
| DE | 102018129826 | A1 | 5/2019 |
| DE | 112020007585 | T5 | 7/2023 |

* cited by examiner

*Primary Examiner* — Nathan C Zollinger
(74) *Attorney, Agent, or Firm* — Ingrassia Fisher & Lorenz, LLP | IF&L

(57) ABSTRACT

A pump housing associated with a vehicle includes a housing body that at least partially defines a pump chamber. The pump chamber is configured to at least partially receive a pump. The pump housing includes a chamber cover configured to be removably coupled to the housing body. The chamber cover includes a mating surface that is configured to contact the housing body when the chamber cover is coupled to the housing body. The mating surface defines a sealing member groove spaced apart from an exterior surface of the chamber cover and a drain configured to fluidly couple the sealing member groove with the exterior surface. The sealing member groove has a depth and the drain has a drain depth that is 45% or less of the depth of the sealing member groove.

20 Claims, 13 Drawing Sheets

PUMP SEALING MEMBER GROOVE WITH DRAIN FOR A VEHICLE

INTRODUCTION

The technical field generally relates to a pump housing for use with a vehicle, and more particularly relates to a pump housing for use with a propulsion system of a vehicle having a drain.

Generally, a vehicle may include one or more pumps, which supply fluids, such as coolant, lubricating fluid, etc. to various components of the vehicle during operation. Typically, the pumps are at least partially enclosed by a pump housing. During the manufacture and/or assembly of the pump, the pump may be subjected to testing. In certain instances, the pump and the pump housing may be exposed to fluid during the testing, and the fluid may accumulate in features of the pump housing. The accumulated fluid may not be visible upon inspection of the pump housing, and may not be identified until after the pump housing is installed in the vehicle.

Accordingly, it is desirable to limit accumulated fluid in the pump housing prior to installation in the vehicle. Furthermore, other desirable features and characteristics of the present disclosure will become apparent from the subsequent detailed description and the appended claims, taken in conjunction with the accompanying drawings and the foregoing technical field and background.

SUMMARY

According to various embodiments, provided is a pump housing associated with a vehicle. The pump housing includes a housing body that at least partially defines a pump chamber. The pump chamber is configured to at least partially receive a pump. The pump housing includes a chamber cover configured to be removably coupled to the housing body. The chamber cover includes a mating surface that is configured to contact the housing body when the chamber cover is coupled to the housing body. The mating surface defines a sealing member groove spaced apart from an exterior surface of the chamber cover and a drain configured to fluidly couple the sealing member groove with the exterior surface. The sealing member groove has a depth and the drain has a drain depth that is 45% or less of the depth of the sealing member groove.

The drain is a slot defined through the mating surface. The drain includes a plurality of drain slots that are spaced apart about a perimeter of the mating surface. The housing body at least partially defines the pump chamber and a second pump chamber, a second chamber cover is configured to be removably coupled to the second pump chamber and the second chamber cover includes a second mating surface that defines a second sealing member groove that is spaced apart from a second exterior surface of the second chamber cover, and the second mating surface is configured to contact the housing body. The second mating surface defines a second drain that is configured to fluidly couple the second sealing member groove with the second exterior surface. The chamber cover includes a fluid coupling defined through the exterior surface and fluidly coupled to the sealing member groove. The fluid coupling includes a contact surface that surrounds a bore, and the bore is defined between the exterior surface and the sealing member groove. The bore has a diameter that is less than the depth of the sealing member groove. The drain is defined on the chamber cover so as to be substantially opposite the fluid coupling. The pump housing is coupled externally to a propulsion system of the vehicle.

Further provided according to various embodiments is a vehicle. The vehicle includes a propulsion system, and a pump configured to be fluidly coupled to the propulsion system to supply the propulsion system with a fluid. The vehicle includes a pump housing configured to be externally coupled to the propulsion system. The pump housing includes a housing body that at least partially defines a pump chamber to at least partially receive the pump and a chamber cover configured to be removably coupled to the housing body. The chamber cover includes a mating surface that defines a sealing member groove that is spaced apart from an exterior surface of the chamber cover and a drain configured to fluidly couple the sealing member groove with the exterior surface. The sealing member groove has a depth and the drain has a drain depth that is 45% or less of the depth of the sealing member groove.

The drain is a slot defined through the mating surface. The drain includes a plurality of drain slots that are spaced apart about a perimeter of the mating surface. The housing body at least partially defines the pump chamber and a second pump chamber, a second chamber cover is configured to be removably coupled to the second pump chamber and the second chamber cover includes a second mating surface that defines a second sealing member groove that is spaced apart from a second exterior surface of the second chamber cover, and the second mating surface is configured to contact the housing body. The second mating surface defines a second drain that is configured to fluidly couple the second sealing member groove with the second exterior surface. The second drain includes a plurality of second drains, and each of the plurality of second drains is a slot defined through the second mating surface. The chamber cover includes a fluid coupling defined through the exterior surface and fluidly coupled to the sealing member groove. The fluid coupling includes a contact surface that surrounds a bore, and the bore is defined between the exterior surface and the sealing member groove. The bore has a diameter that is less than a cross-sectional diameter of a sealing member coupled to the sealing member groove. The drain is defined on the chamber cover so as to be substantially opposite the fluid coupling.

BRIEF DESCRIPTION OF THE DRAWINGS

The exemplary embodiments will hereinafter be described in conjunction with the following drawing figures, wherein like numerals denote like elements, and wherein.

DETAILED DESCRIPTION

The following detailed description is merely exemplary in nature and is not intended to limit the application and uses. Furthermore, there is no intention to be bound by any expressed or implied theory presented in the preceding introduction, brief summary or the following detailed description. In addition, the connecting lines shown in the various figures contained herein are intended to represent example functional relationships and/or physical couplings between the various elements. It should be noted that many alternative or additional functional relationships or physical connections may be present in an embodiment of the present disclosure.

As used herein, the term "axial" refers to a direction that is generally parallel to or coincident with an axis of rotation, axis of symmetry, or centerline of a component or components. For example, in a cylinder or disc with a centerline and generally circular ends or opposing faces, the "axial" direction may refer to the direction that generally extends in parallel to the centerline between the opposite ends or faces. In certain instances, the term "axial" may be utilized with respect to components that are not cylindrical (or otherwise radially symmetric). For example, the "axial" direction for a rectangular housing containing a rotating shaft may be viewed as a direction that is generally parallel to or coincident with the rotational axis of the shaft. Furthermore, the term "radially" as used herein may refer to a direction or a relationship of components with respect to a line extending outward from a shared centerline, axis, or similar reference, for example in a plane of a cylinder or disc that is perpendicular to the centerline or axis. In certain instances, components may be viewed as "radially" aligned even though one or both of the components may not be cylindrical (or otherwise radially symmetric). Furthermore, the terms "axial" and "radial" (and any derivatives) may encompass directional relationships that are other than precisely aligned with (e.g., oblique to) the true axial and radial dimensions, provided the relationship is predominantly in the respective nominal axial or radial direction. As used herein, the term "about" denotes within 10% to account for manufacturing tolerances. In addition, the term "substantially" denotes within 10% to account for manufacturing tolerances.

Figure 1:
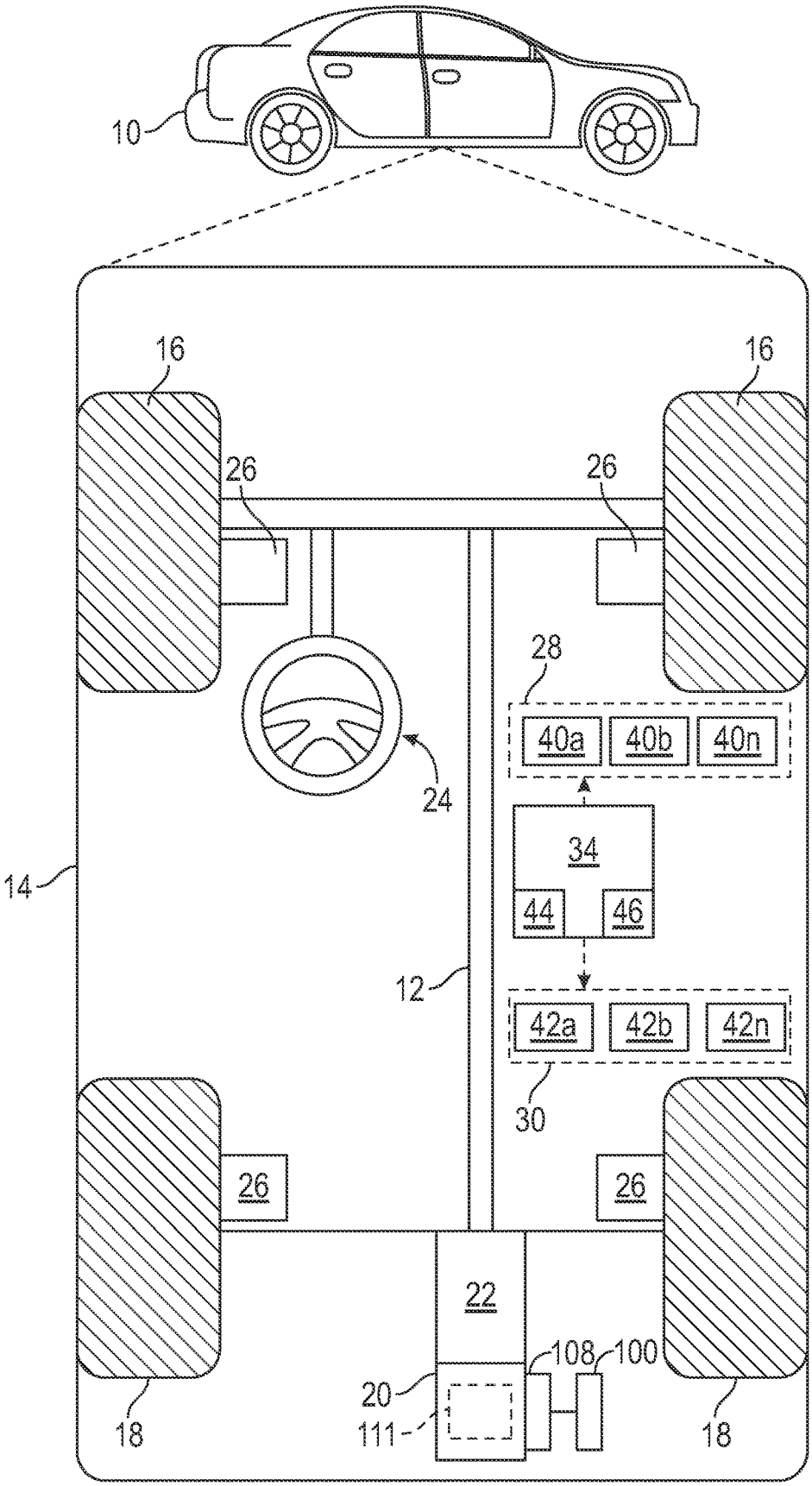
FIG. 1 is a functional block diagram illustrating a vehicle including a pump housing with a drain that is associated with a propulsion system of the vehicle in accordance with various embodiments.
Figure 1A:
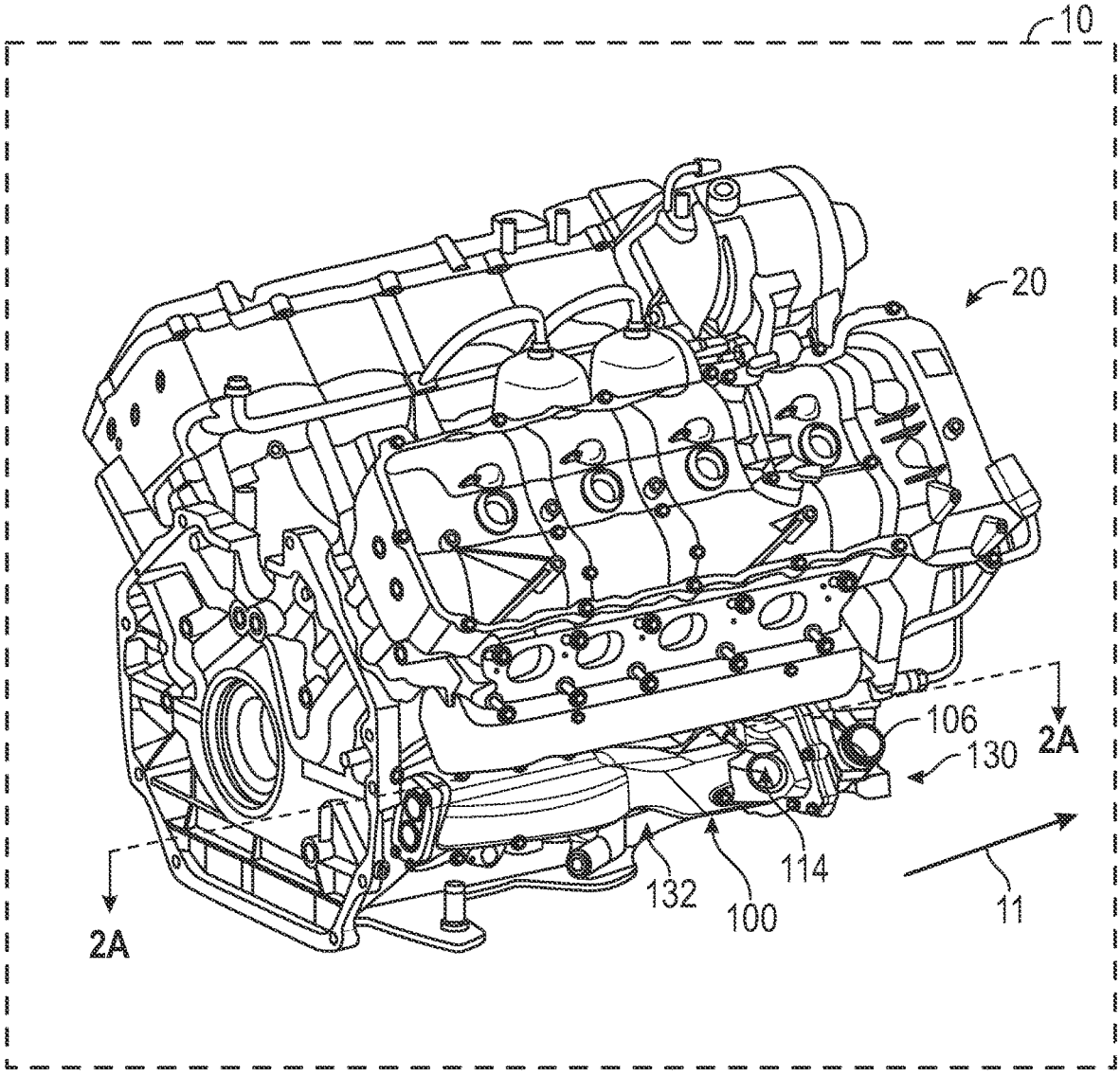
FIG. 1A is a schematic perspective illustration of the pump housing coupled to the propulsion system of FIG. 1 in accordance with various embodiments.

With reference to FIGS. 1 and 1A, a pump housing shown generally as 100 is associated with a vehicle 10 in accordance with various embodiments. As will be described, the pump housing 100 enables a fluid accumulated on the pump housing 100 to drain from the pump housing 100 prior to installation in the vehicle 10. In this example, the pump housing 100 is coupled to a propulsion system 20 of the vehicle 10 so as to be disposed wholly external or exterior of the propulsion system 20 (FIG. 1A), however, in other embodiments, the pump housing 100 may be internal to the propulsion system 20 and coupled within the propulsion system 20. In FIG. 1A, a direction of a front of the vehicle 10 is represented by the arrow labeled 11. In this example, the pump housing 100 is coupled to the propulsion system 20 so as to be on a side of an engine associated with the propulsion system 20, however, it should be noted that the pump housing 100 may be mounted or coupled to the propulsion system 20 in various ways.

As depicted in FIG. 1, the vehicle 10 generally includes a chassis 12, a body 14, front wheels 16, and rear wheels 18. The body 14 is arranged on the chassis 12 and substantially encloses components of the vehicle 10. The body 14 and the chassis 12 may jointly form a frame. The vehicle wheels 16-18 are each rotationally coupled to the chassis 12 near a respective corner of the body 14. In various embodiments, the vehicle 10 is an autonomous vehicle or a semi-autonomous vehicle. As can be appreciated, the pump housing 100 can be implemented in other non-autonomous systems and is not limited to the present embodiments. The vehicle 10 is depicted in the illustrated embodiment as a passenger car, but it should be appreciated that any other vehicle, including motorcycles, trucks, sport utility vehicles (SUVs), recreational vehicles (RVs), etc., can also be used.

As shown, the vehicle 10 generally includes the propulsion system 20, a transmission system 22, a steering system 24, a brake system 26, a sensor system 28, an actuator system 30 and at least one controller 34. The propulsion system 20 may, in various embodiments, include an internal combustion engine, an electric machine such as a traction motor, and/or a fuel cell propulsion system. In this example, the propulsion system 20 is an internal combustion engine. The transmission system 22 is configured to transmit power from the propulsion system 20 to the vehicle wheels 16 and 18 according to selectable speed ratios. According to various embodiments, the transmission system 22 may include a step-ratio automatic transmission, a continuously-variable transmission, or other appropriate transmission.

The brake system 26 is configured to provide braking torque to the vehicle wheels 16 and 18. Brake system 26 may, in various embodiments, include friction brakes, brake by wire, a regenerative braking system such as an electric machine, and/or other appropriate braking systems.

The steering system 24 influences a position of the vehicle wheels 16 and/or 18. While depicted as including a steering wheel 24*a* for illustrative purposes, in some embodiments contemplated within the scope of the present disclosure, the steering system 24 may not include a steering wheel.

The sensor system 28 includes one or more sensing devices 40*a*-40*n* that sense observable conditions of the exterior environment and/or the interior environment of the vehicle 10. In various embodiments, the sensing devices 40*a*-40*n* include, but are not limited to, radars (e.g., long-range, medium-range-short range), lidars, global positioning systems, optical cameras (e.g., forward facing, 360-degree, rear-facing, side-facing, stereo, etc.), thermal (e.g., infrared)

cameras, ultrasonic sensors, odometry sensors (e.g., encoders) and/or other sensors that might be utilized in connection with systems and methods in accordance with the present subject matter. The sensor system 28 is in communication with the controller 34 over a communication medium.

The actuator system 30 includes one or more actuator devices 42*a*-42*n* that control one or more vehicle features such as, but not limited to, the propulsion system 20, the transmission system 22, the steering system 24, and the brake system 26. In various embodiments, the vehicle 10 may also include interior and/or exterior vehicle features not illustrated in FIG. 1, such as various doors, a trunk, and cabin features such as air, music, lighting, touch-screen display components, active safety seat or haptic seat, and the like.

The controller 34 includes at least one processor 44 and a computer-readable storage device or media 46. The processor 44 may be any custom-made or commercially available processor, a central processing unit (CPU), a graphics processing unit (GPU), an application specific integrated circuit (ASIC) (e.g., a custom ASIC implementing a neural network), a field programmable gate array (FPGA), an auxiliary processor among several processors associated with the controller 34, a semiconductor-based microprocessor (in the form of a microchip or chip set), any combination thereof, or generally any device for executing instructions. The computer readable storage device or media 46 may include volatile and nonvolatile storage in read-only memory (ROM), random-access memory (RAM), and keep-alive memory (KAM), for example. KAM is a persistent or non-volatile memory that may be used to store various operating variables while the processor 44 is powered down. The computer-readable storage device or media 46 may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller 34 in controlling the vehicle 10.

Figure 2:
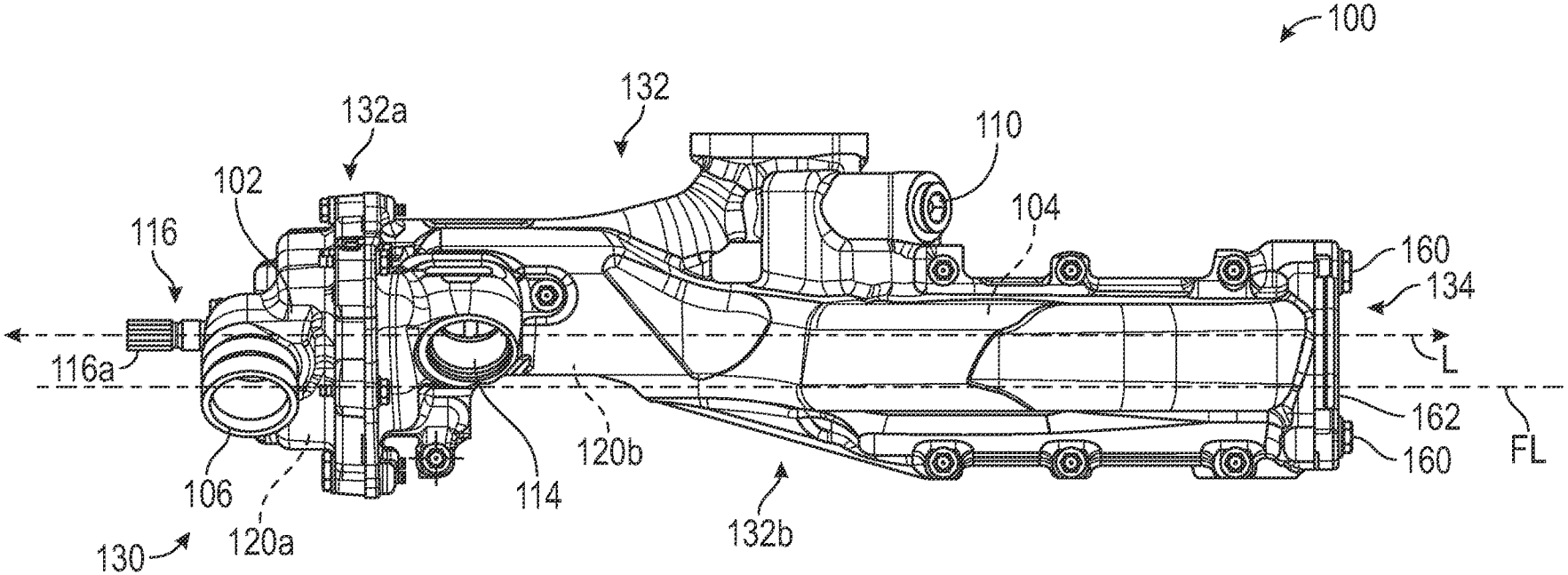
FIG. 2 is a front view of the pump housing, which encloses at least a portion of a first pump and a second pump associated with the vehicle in accordance with various embodiments.
Figure 2A:
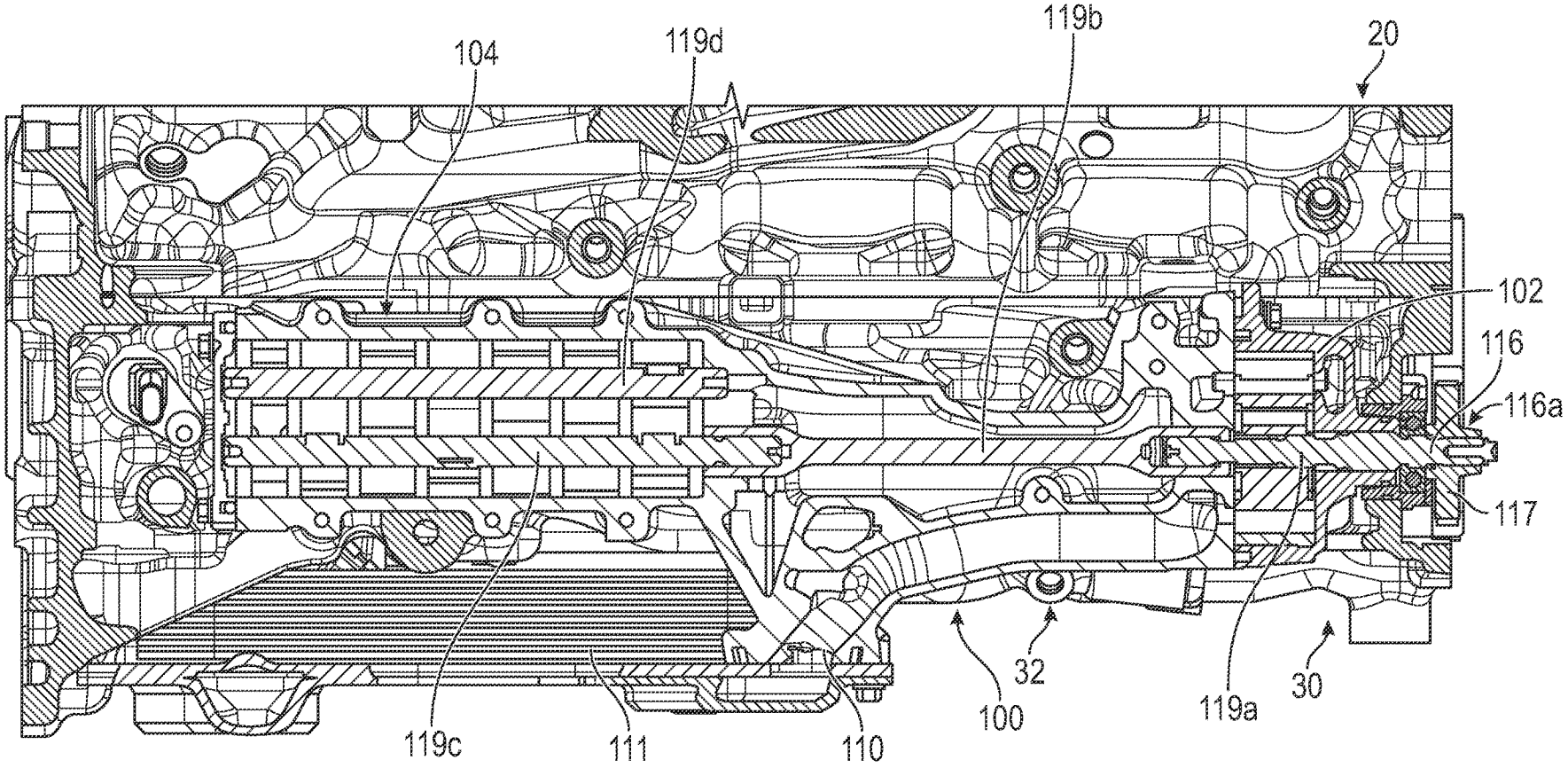
FIG. 2A is a cross-sectional view of the pump housing and a portion of the propulsion system, taken from line 2A-2A of FIG. 1A.

With reference to FIG. 2, the pump housing 100 is shown in greater detail. In one example, the pump housing 100 encloses a first pump 102 and a second pump 104. In this example, the first pump 102 is an oil supply pump, and the second pump 104 is an oil scavenge pump. It should be noted that in other examples, the pump housing 100 may be configured to enclose a single pump and moreover, the principles discussed herein may be applied to pumps associated with other fluids. Briefly, the first pump 102 is a single chamber continuously variable vane pump, which is enclosed within the pump housing 100. The first pump 102 receives a fluid, such as oil, through a supply inlet 106 defined in the pump housing 100. The supply inlet 106 is fluidly coupled to a tank, such as an oil tank 108 (FIG. 1) via one or more conduits, hoses, couplings, etc. The pump housing 100 also defines a first pump outlet 110. With reference to FIG. 2A, the first pump 102 discharges the pressurized fluid or oil through the first pump outlet 110, and from the first pump outlet 110, the pressurized fluid or oil may be supplied to an oil cooler 111 associated with the propulsion system 20, for example.

Figure 3:
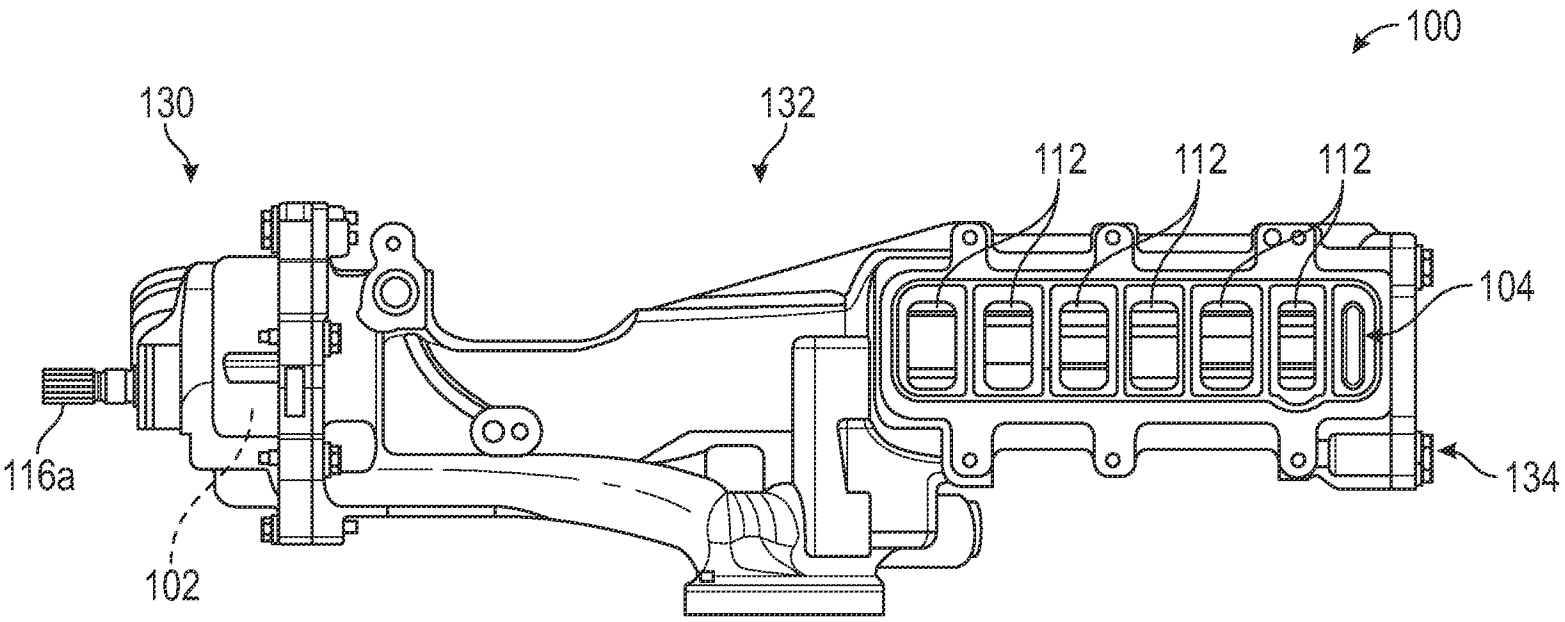
FIG. 3 is a rear view of the pump housing in accordance with various embodiments.

The second pump 104 is a six-stage pump, and comprises, but is not limited to, a six-stage gear pump. With reference to FIG. 3, the pump housing 100 may define six second inlets 112, which fluidly couple the gears associated with the second pump 104 to the propulsion system 20, for example. It should be noted that while the second pump 104 is described herein as a six-stage gear pump, the second pump 104 may have any desired configuration, including any number of stages and the pump housing 100 may be configured to correspond with the second pump 104. Further, it should be noted that in other embodiments, the second pump may comprise a gerotor pump, and thus, the second pump is not limited to a gear pump. With reference back to FIG. 2, the pump housing 100 also defines a second pump outlet 114. The second pump outlet 114 is in fluid communication with the oil tank 108 via one or more conduits, hoses, couplings, etc. to return the oil scavenged by the second pump 104 to the oil tank 108.

The first pump 102 and the second pump 104 may be driven via a pump drive shaft 116. The pump drive shaft 116 may extend along a longitudinal axis L associated with the pump housing 100. With reference to FIG. 2A, the pump drive shaft 116 may include a gear 116*a*, such as a spur gear, which may be coupled to or meshingly engaged with a drive pulley 117 associated with the propulsion system 20 such that the propulsion system 20 drives the first pump 102 and the second pump 104. For example, the gear 116*a* may be coupled to or meshingly engaged with mating teeth defined about a central bore of the drive pulley 117, and the drive pulley 117 may be associated with a crankshaft of the propulsion system 20 via a belt or the like such that a rotation of the crankshaft drives the first pump 102 and the second pump 104. It should be noted that other techniques may be employed to drive the first pump 102 and the second pump 104.

In this example, the pump drive shaft 116 is a multiple piece shaft, and includes a first drive shaft 119*a*, a second drive shaft 119*b* and a third drive shaft 119*c*. The first drive shaft 119*a* is coupled to the second drive shaft 119*b* to rotate with the first drive shaft 119*a*. The first drive shaft 119*a* drives the first pump 102. The second drive shaft 119*b* is coupled to the third drive shaft 119*c* to rotate with the third drive shaft 119*c*. The third drive shaft 119*c* drives a portion of the gears of the second pump 104. In this example, the gears associated with the third drive shaft 119*c* are meshingly engaged with gears associated with a fourth drive shaft 119*d* such that the rotation of the third drive shaft 119*c* rotates the gears coupled to the third drive shaft 119*c*, which in turn, rotates the gears coupled to the fourth drive shaft 119*d*.

Thus, in this example, the pump housing 100 defines two pump chambers: a first pump chamber 120*a* and a second pump chamber 120*b*, which are discrete and substantially fluidly isolated from each other. The first pump chamber 120*a* is associated with the first pump 102 and the second pump chamber 120*b* is associated with the second pump 104. The second portion 132*b* encloses the second pump 104. Generally, the pump housing 100 defines a scavenge side (the second pump chamber 120*b* that contains the second pump 104) and a supply side (the first pump chamber 120*a* that contains the first pump 102) of an oil system. In this example, the pump housing 100 includes a first chamber cover 130, a housing body 132 and a second chamber cover 134. Generally, the first chamber cover 130, the housing body 132 and the second chamber cover 134 are each composed of metal or metal alloy, and cast, machined, additively manufactured, etc. In one example, the first chamber cover 130 cooperates with a first portion 132*a* of the housing body 132 to define the first pump chamber 120*a* and the second chamber cover 134 cooperates with a second portion 132*b* of the housing body 132 to define the second pump chamber 120*b*.

Figure 4:
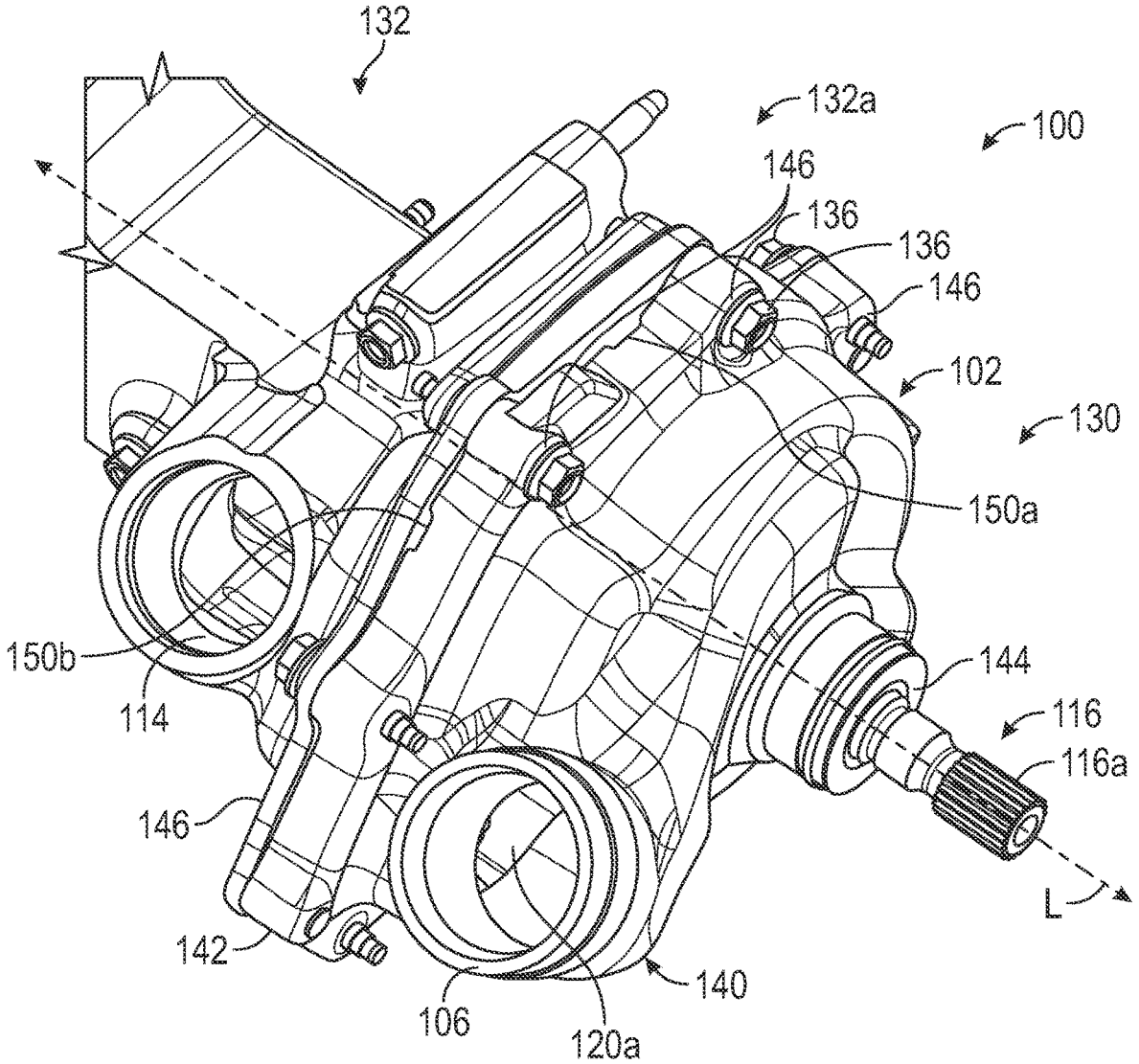
FIG. 4 is a detail perspective view of a first chamber cover and a first portion of a housing body of the pump housing of FIG. 2.
Figure 5:
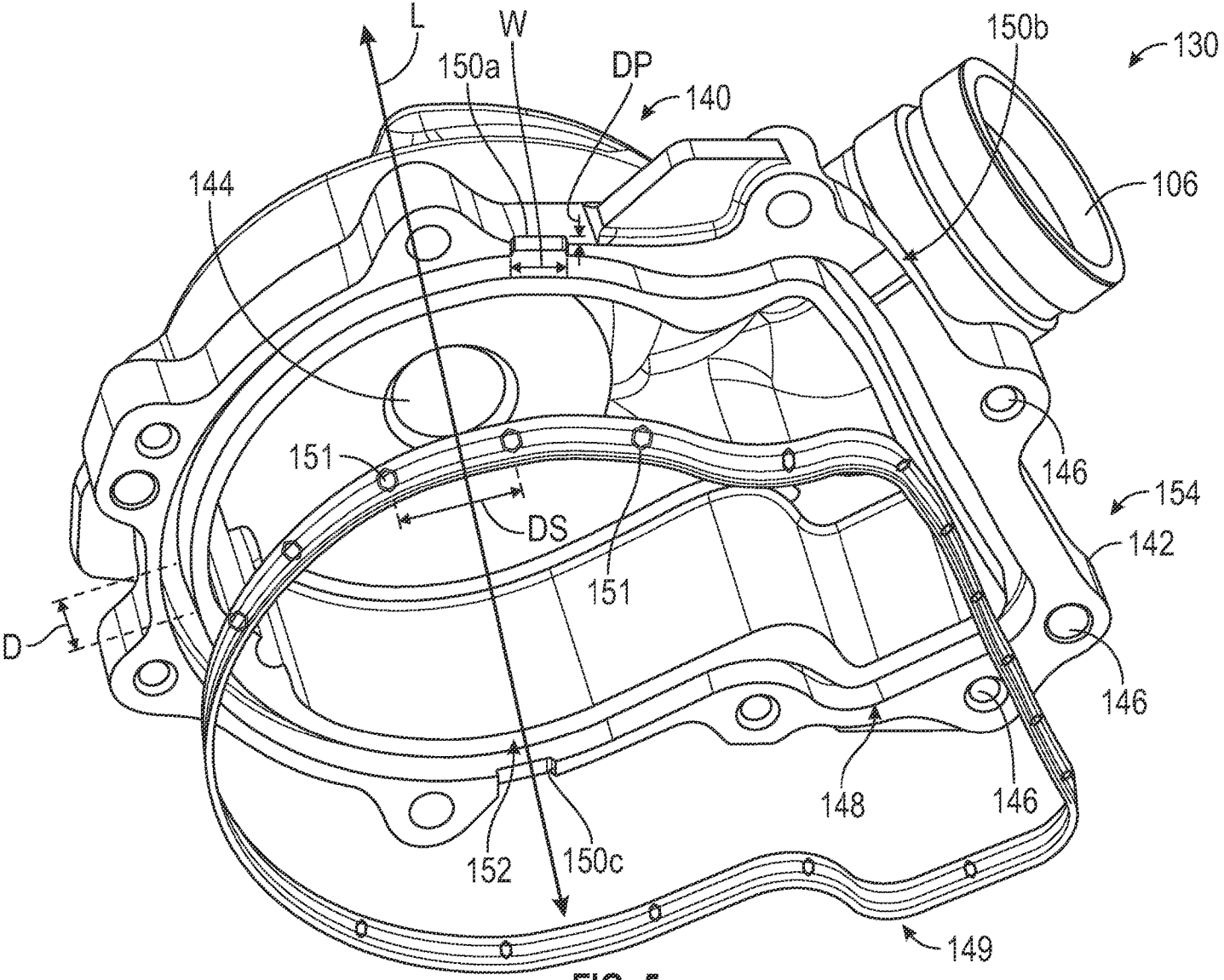
FIG. 5 is a perspective end view of the first chamber cover of FIG. 4.

The first chamber cover 130 is removably coupled to the housing body 132. With reference to FIG. 4, the first chamber cover 130 and the first portion 132*a* of the housing body 132 are shown. The first chamber cover 130 is removably coupled to the first portion 132*a* via one or more mechanical fasteners 136, which comprise bolts in this example. The first chamber cover 130 is removably coupled to the housing body 132 to provide access to the first pump 102 for repair, maintenance, etc. In this example, the first chamber cover 130 includes a first, exterior surface 140, a second, interior surface 142 (FIG. 5), the supply inlet 106, a pump drive shaft receptacle 144, at least one or a plurality of coupling bores 146, a sealing member groove 148 (FIG. 5), at least one drain 150 and a counterbore 152 (FIG. 5). The coupling bores 146, the sealing member groove 148 and the at least one drain 150 are each defined in a first flange 154, which extends about a perimeter of the counterbore 152.

The first, exterior surface 140 defines an exterior of the first chamber cover 130. The first, exterior surface 140 is opposite the second, interior surface 142. The supply inlet 106 is defined through the first, exterior surface 140 and the second, interior surface 142 so as to extend along an axis that is substantially oblique to the longitudinal axis L of the pump housing 100. The supply inlet 106 fluidly couples the first pump chamber 120*a* to the oil tank 108 (FIG. 1). The pump drive shaft receptacle 144 is substantially cylindrical, and includes a central bore 144*a* that is sized to receive the pump drive shaft 116. The pump drive shaft receptacle 144 generally extends outwardly from the first, exterior surface 140 to provide clearance for coupling the pump drive shaft 116 to the propulsion system 20. The pump drive shaft receptacle 144 is defined at a first end of the first chamber cover 130, which is opposite a second end of the first chamber cover 130.

The first flange 154 is integrally formed with the first chamber cover 130.

Generally, the first flange 154 defines a mating surface for coupling the first chamber cover 130 to the first portion 132*a* of the housing body 132. The first flange 154 is defined at the second end of the first chamber cover 130 so as to be substantially opposite the pump drive shaft receptacle 144. The plurality of coupling bores 146 are spaced apart about a perimeter of the first flange 154. The coupling bores 146 are defined through the first, exterior surface 140 and the second, interior surface 142 at the first flange 154. When the first chamber cover 130 is positioned adjacent to the first portion 132*a*, each of the coupling bores 146 is coaxially aligned with a respective bore defined through the first portion 132*a*. Each of the coupling bores 146 is configured to receive a respective one of the mechanical fasteners 136 to couple the first chamber cover 130 to the first portion 132*a* of the housing body 132.

The sealing member groove 148 is defined into the second, interior surface 142 at the first flange 154 so as to extend about and substantially circumscribe a perimeter of the first chamber cover 130. The sealing member groove 148 is defined axially into the second, interior surface 142 for a depth D, which is predetermined to enable receipt of a sealing member 149 (FIG. 5), such as a press-in-place elastomeric gasket. Generally, the depth D is about 6 millimeters (mm), however, the depth D may vary based on the type of sealing member employed. When the first chamber cover 130 is coupled to the first portion 132*a* of the housing body 132, the first chamber cover 130 and the first portion 132*a* cooperate to compress the sealing member 149, which substantially circumscribes the perimeter of the first chamber cover 130, to seal the first chamber cover 130 against the housing body 132. In one example, the sealing member groove 148 is defined in the second, interior surface 142 at the first flange 154 so as to surround the counterbore 152.

The counterbore 152 is defined at the second, interior surface 142 to extend axially inward from the second end to the first end of the first chamber cover 130. The counterbore 152 is sized and shaped to at least partially receive the first pump 102 and to couple the first pump 102 to the first drive shaft 119*a* (FIG. 2A).

In one example, the at least one drain 150 comprises three drains 150*a*, 150*b*, 150*c*, which are slots defined in the second, interior surface 142 at the first flange 154. Each of the drains 150*a*, 150*b*, 150*c* is defined with a drain depth DP, which is less than about 50% of the depth D of the sealing member groove 148. In one example, the drain depth DP is about 1.2 millimeters (mm). By providing the drains 150*a*, 150*b*, 150*c* with the drain depth DP, the sealing member 149 remains seated within and retained by the sealing member groove 148 to maintain the seal between the first chamber cover 130 and the housing body 132 while enabling fluid, such as oil, trapped in the sealing member groove 148 to drain from the pump housing 100 prior to installation in the vehicle 10. In this example, with reference to FIG. 5, each of the drains 150*a*, 150*b*, 150*c* are defined in the second, interior surface 142 to have a width W, which is about 8 millimeters (mm). The width W of the drains 150*a*, 150*b*, 150*c* ensures that a stabilizer 151 associated with the sealing member 149 does not contact the respective one of the drains 150*a*, 150*b*, 150*c*. In other embodiments, the width W may comprise less than 50% a distance DS between the stabilizers 151 associated with the sealing member 149. For example, the distance between stabilizers 151 associated with the sealing member is about 16 millimeters (mm), and the second width W2 would be less than about 8 millimeters (mm). In this example, each of the widths W and the drain depths DP are the same, but in other examples, one or more of the widths W and/or the drain depths DP may vary. In addition, it should be noted that one or more of the widths W may taper such that one or more of the drains 150*a*, 150*b*, 150*c* may have a width at the sealing member groove 148 that is different and less than a width of the respective drain 150*a*, 150*b*, 150*c* at the first, exterior surface 140. As will be discussed, generally, the drains 150*a*, 150*b*, 150*c* are sized and shaped to enable the fluid or oil that may enter the sealing member groove 148 to drain from the first chamber cover 130 or to drain external to the pump housing 100 prior to installation in the vehicle 10. By draining the fluid or oil in the sealing member groove 148 prior to installation in the vehicle 10, the drains 150*a*, 150*b*, 150*c* ensure that any fluid accumulated in the pump housing 100 is removed prior to installation.

In this example, the three drains 150*a*, 150*b*, 150*c* are spaced apart about the perimeter of the first flange 154. Generally, at least one of the drains 150*a*, 150*b*, 150*c* is orientated to enable gravity to assist in drawing the fluid from the sealing member groove 148. The drain 150*a* is defined through the first flange 154 so as to be offset from the longitudinal axis L toward the supply inlet 106. The drain 150*a* may also act as an inlet to enable air to enter into the sealing member groove 148 to assist in expelling the fluid from the sealing member groove 148. The drain 150*b* is defined through the first flange 154 so as to be aligned with the supply inlet 106. The drain 150*b* is orientated downward to enable gravity to assist in draining the fluid or oil during manufacturing. The drain 150*c* is defined through the first flange 154 as to be aligned with the longitudinal axis L and circumferentially offset from the drain 150*a*. The drain 150*c* is orientated downward to enable gravity to assist in draining the fluid or oil during shipping. Stated another way, the drain 150*a* is orientated upward or near a first surface of the first chamber cover 130; the drain 150*b* is orientated proximate the supply inlet 106 and the second pump outlet 114 to be facing downward when the pump housing 100 is oriented to drain fluid from the supply inlet 106 and the second pump outlet 114; and the drain 150*c* is orientated downward or near a second surface of the first chamber cover 130, which is substantially opposite the first surface. This ensures that as the pump housing 100 is manufactured and handled during shipping in various orientations, the fluid or oil drains from one of the drains 150*a*, 150*b*, 150*c* associated with the pump housing 100.

With reference back to FIGS. 2 and 3, the housing body 132 includes the first portion 132*a* and the second portion 132*b*, which are substantially fluidly isolated from each other. The first portion 132*a* is substantially cylindrical, and is sized to at least partially receive the first pump 102. The first portion 132*a* also includes the first pump outlet 110, which may include a conduit that fluidly couples the first portion 132*a* with the first pump outlet 110. The second portion 132*b* substantially encloses the second pump 104. The second pump outlet 114 is defined in the second portion 132*b* so as to be proximate the first portion 132*a*, and the second inlets 112 are defined so as to be spaced apart from the second pump outlet 114. Generally, the second portion 132*b* may include a conduit defined between the second pump outlet 114 and the second inlets 112 to enclose components associated with the second pump 104. The second inlets 112 are defined through the second portion 132*b* so as to be adjacent to or proximate the second chamber cover 134. The housing body 132 may be composed of discrete components, which are coupled together via one or more mechanical fasteners, such as a bolts, or may be monolithic or one-piece.

Figure 6:
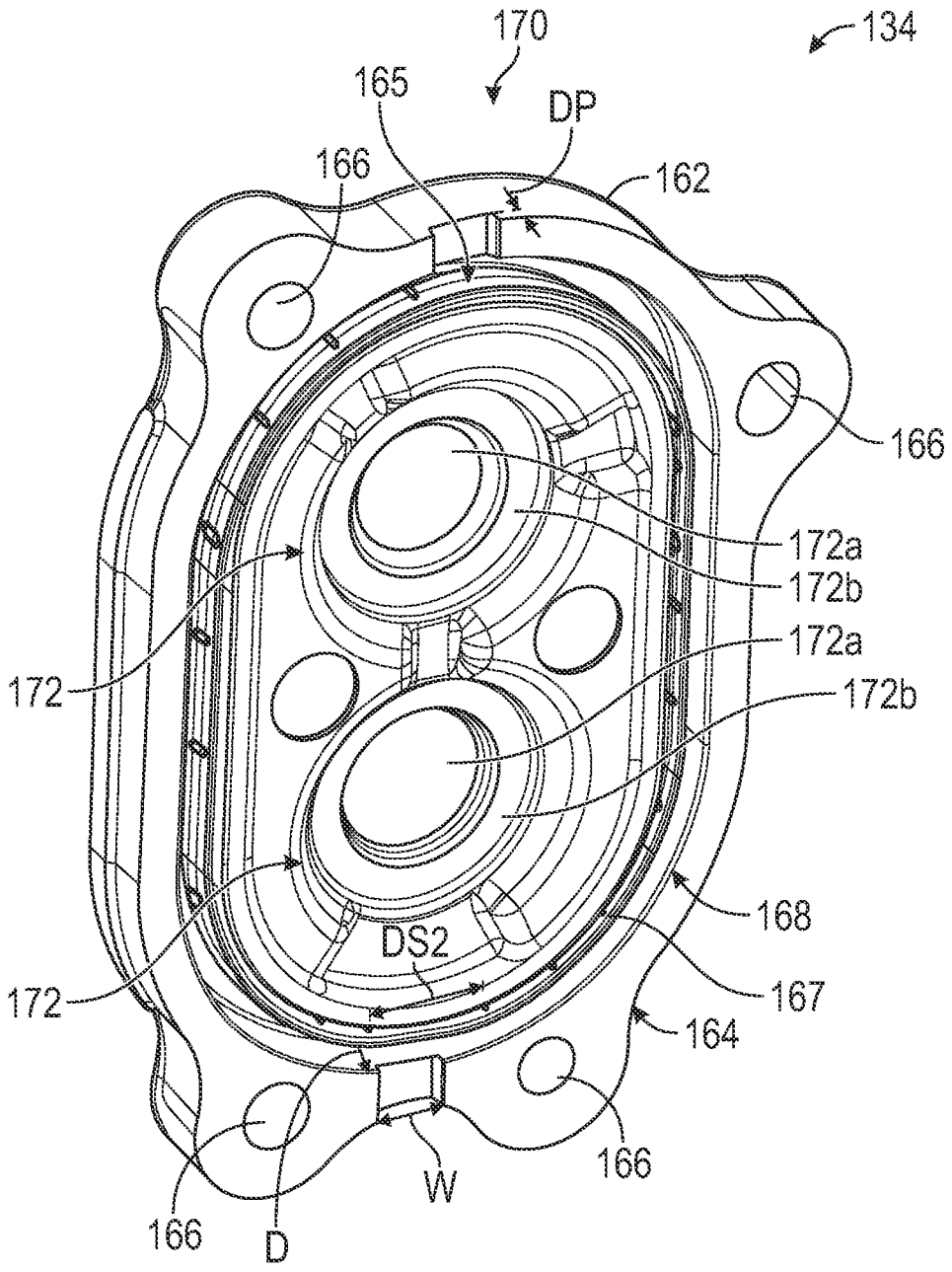
FIG. 6 is a perspective end view of a second chamber cover associated with the pump housing in accordance with various embodiments.

The second chamber cover 134 is removably coupled to the housing body 132 proximate the second inlets 112. The second chamber cover 134 is removably coupled to the first portion 132*a* via one or more mechanical fasteners 160, which comprise bolts in this example. The second chamber cover 134 is removably coupled to enable access to the second pump 104 for repair, maintenance, etc. In this example, with reference to FIG. 6, the second chamber cover 134 includes a third, exterior surface 162, a fourth, interior surface 164 (FIG. 5), at least one or a plurality of second coupling bores 166, a second sealing member groove 168, at least one second drain 170 and a pair of alignment surfaces 172.

The third, exterior surface 162 is substantially planar or flat, and forms a part of the exterior surface of the pump housing 100. The fourth, interior surface 164 is opposite the third, exterior surface 162, and the fourth, interior surface 164 forms a second mating surface, which is in contact with the housing body 132 when the second chamber cover 134 is coupled to the housing body 132. The second sealing member groove 168, the at least one second drain 170 and the pair of alignment surfaces 172 are defined in the fourth, interior surface 164. The plurality of second coupling bores 166 are each defined in a respective flange 174, which extends outwardly from a perimeter of the second chamber cover 134. In this example, the second chamber cover 134 includes two flanges 174 with a respective second coupling bore 166 proximate or at a first end of the second chamber cover 134, and includes two flanges 174 with a respective second coupling bore 166 at a second end of the second chamber cover 134, with the second end of the second chamber cover 134 opposite the first end. It should be noted that any arrangement may be used to couple the second chamber cover 134 to the housing body 132.

The second sealing member groove 168 is defined into the fourth, interior surface 164 so as to extend about and substantially circumscribe a perimeter of the second chamber cover 134. The second sealing member groove 168 is defined axially into the fourth, interior surface 164 for the depth D, which is predetermined to enable receipt of a second sealing member 165, such as a press-in-place elastomeric gasket. When the second chamber cover 134 is coupled to the second portion 132*b* of the housing body 132, the second chamber cover 134 and the second portion 132*b* cooperate to compress the second sealing member 165, which substantially circumscribes the perimeter of the second chamber cover 134, to seal the second chamber cover 134 against the housing body 132. In one example, the second sealing member groove 168 is defined in the fourth, interior surface 164 so as to surround the pair of alignment surfaces 172.

In one example, the at least one second drain 170 comprises two second drains 170*a*, 170*b*, which are slots defined in the fourth, interior surface 164. Each of the second drains 170*a*, 170*b* are defined with the drain depth DP, which is about 40% to about 50% the depth D of the second sealing member groove 168. By providing the second drains 170*a*, 170*b* with the drain depth DP, the second sealing member 165 remains seated within and retained by the second sealing member groove 168 to maintain the seal between the second chamber cover 134 and the housing body 132 while enabling fluid, such as oil, trapped in the second sealing member groove 168 to drain from the pump housing 100 prior to installation in the vehicle 10. In this example, each of the second drains 170*a*, 170*b* are defined in the fourth, interior surface 164 to have a second width W2, which is about 4 millimeters (mm) to about 8 millimeters (mm). The second width W2 of the second drains 170*a*, 170*b* ensures that a stabilizer 167 associated with the second sealing member 165 does not contact the respective one of the second drains 170*a*, 170*b*. In other embodiments, the second width W2 may comprise less than 50% a distance DS2 between the stabilizers 167 associated with the second sealing member 165. For example, the distance between stabilizers 167 associated with the second sealing member 165 is about 16 millimeters (mm), and the second width W2 in this example would be less than about 8 millimeters (mm). In this example, each of the second widths W2 and the drain depths DP are the same, but in other examples, one or more of the second widths W2 and/or the drain depths DP may vary. In addition, it should be noted that one or more of the second widths W2 may taper such that one or more of the second drains 170*a*, 170*b* may have a second width at the second sealing member groove 168 that is different and less than a second width of the respective second drain 170*a*, 170*b* at the third, exterior surface 162. As will be discussed, generally, the second drains 170*a*, 170*b* are sized and shaped to enable the fluid or oil that may enter the second sealing member groove 168 to drain from the second chamber cover 134 or to drain external to the pump housing 100 prior to installation in the vehicle 10. By draining the fluid or oil in second sealing member groove 168 prior to installation in the vehicle 10, the second drains 170*a*, 170*b* ensure that any fluid accumulated in the pump housing 100 is removed prior to installation.

In this example, the second drains 170*a*, 170*b* are substantially opposite each other about the perimeter of the second chamber cover 134. Generally, at least one of the second drains 170*a*, 170*b* is orientated to enable gravity to assist in drawing the fluid from the second sealing member groove 168. The second drain 170*a* is defined through the second chamber cover 134 at the first end, and the second drain 170*b* is defined through the second chamber cover 134 at the second end of the second chamber cover 134. The second drain 170*a* may also act as an inlet to enable air to enter into the second sealing member groove 168 to assist in expelling the fluid from the second sealing member groove 168. The second drain 170*b* is orientated downward to enable gravity to assist in draining the fluid or oil during shipping. It should be noted that while the second chamber cover 134 is described and illustrated herein as including the second drains 170*a*, 170*b*, in certain embodiments, the second chamber cover 134 may be devoid of or need not include the second drains 170*a*, 170*b*.

The pair of alignment surfaces 172 are defined as counterbores into the fourth, interior surface 164. Each of the alignment surfaces 172 is circular, and includes at least one recessed tab, which assists in guiding a wave spring into the second chamber cover 134 during assembly. In this example, each of the alignment surfaces 172 defines a thrust face 172*a* for the respective drive shaft 119*c*, 119*d* (FIG. 2A) associated with the second pump 104, along with a seat 172*b* for a wave spring. The seat 172*b* surrounds the thrust face 172*a*. It should be noted that the fourth, interior surface 164 need not include the pair of alignment surfaces 172, if desired.

It should be noted that while the first chamber cover 130 is described herein as including the drains 150*a*, 150*b*, 150*c* to enable fluid or oil to drain from the sealing member groove 148 prior to installation in the vehicle 10, the first chamber cover 130 may be configured differently to enable the fluid or oil to drain from the pump housing 100. In one example, with reference to FIG. 7, a pump housing 200 is shown, which may be coupled externally to the propulsion system 20 associated with the vehicle 10. As the pump housing 200 includes components that are the same or similar to components of the pump housing 100 discussed with regard to FIGS. 1-6, the same reference numerals will be used to denote the same or similar components. The pump housing 200 encloses the first pump 102 and the second pump 104. The first pump 102 receives the fluid or oil through the supply inlet 106 defined in the pump housing 200. The pump housing 200 also defines the first pump outlet 110. The pump housing 200 may define the second inlets 112, which fluidly couple the gears associated with the second pump 104 to the propulsion system 20, for example. The pump housing 200 also defines the second pump outlet 114.

The first pump 102 and the second pump 104 may be driven via the pump drive shaft 116, and the pump drive shaft 116 may extend along a longitudinal axis L2 associated with the pump housing 200. The pump drive shaft 116 may include the gear 116*a*, which may be coupled to or meshingly engaged with a gear associated with the propulsion system 20 such that the propulsion system 20 drives the first pump 102 and the second pump 104.

The pump housing 200 defines the two pump chambers: the first pump chamber 120*a* and the second pump chamber 120*b*. In this example, the pump housing 200 includes a first chamber cover 230, the housing body 132 and the second chamber cover 134. Generally, the first chamber cover 230 is composed of metal or metal alloy, and cast, machined, additively manufactured, etc. In one example, the first chamber cover 230 cooperates with the first portion 132*a* of the housing body 132 to define the first pump chamber 120*a* and the second chamber cover 134 cooperates with the second portion 132*b* of the housing body 132 to define the second pump chamber 120*b*.

Figure 9:
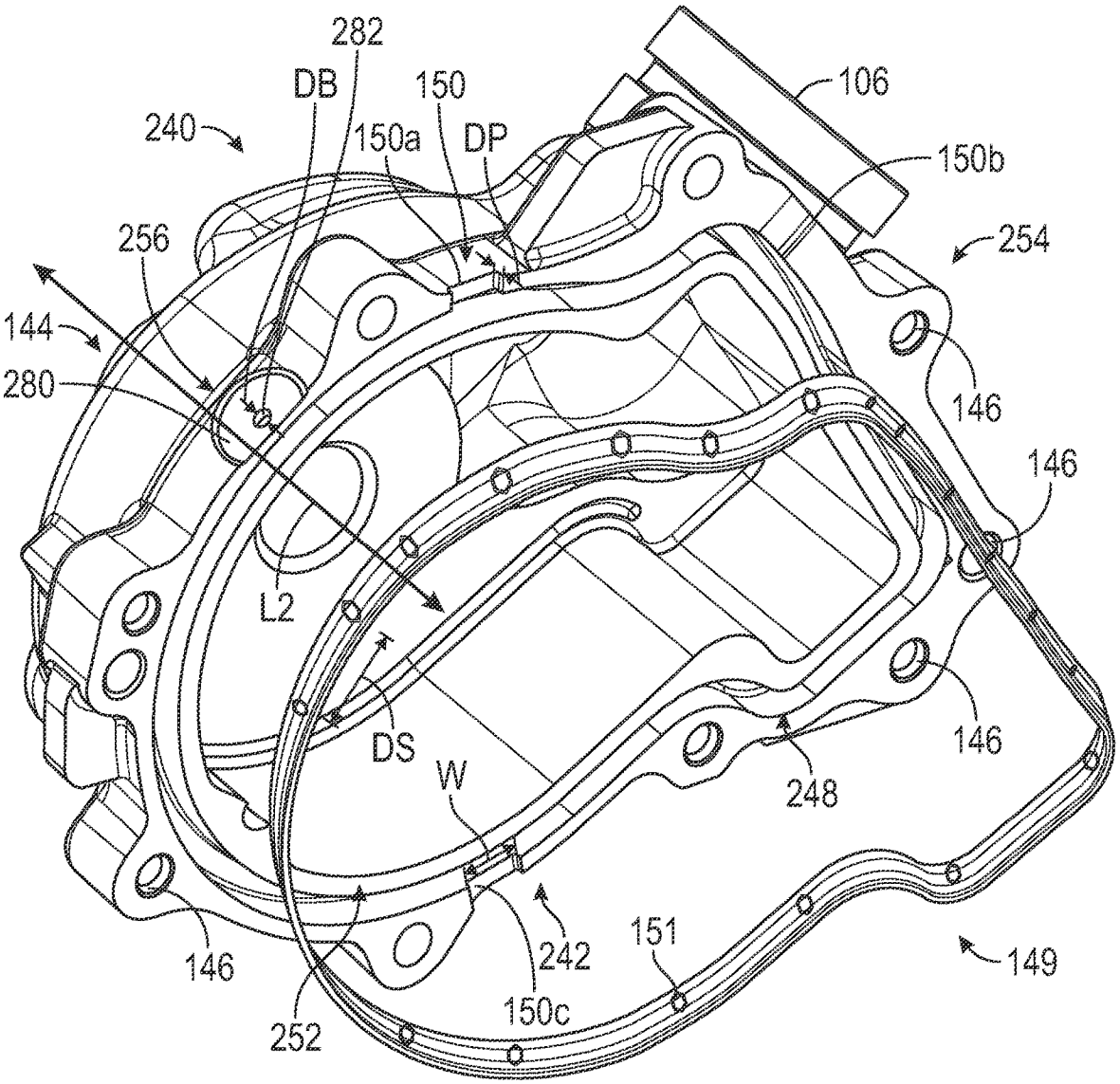
FIG. 9 is a perspective end view of the first chamber cover of FIG. 8.

The first chamber cover 230 is removably coupled to the housing body 132. With reference to FIG. 4, the first chamber cover 230 and the first portion 132*a* of the housing body 132 are shown. The first chamber cover 230 is removably coupled to the first portion 132*a* via the mechanical fasteners 136. The first chamber cover 230 is removably coupled to the housing body 132 to provide access to the first pump 102 for repair, maintenance, etc. In this example, the first chamber cover 230 includes a first, exterior surface 240, a second, interior surface 242 (FIG. 9), the supply inlet 106, the pump drive shaft receptacle 144, the plurality of coupling bores 146, a sealing member groove 248 (FIG. 9), at least one drain 150 and a counterbore 252 (FIG. 9). The coupling bores 146, the sealing member groove 248 and the at least one drain 150 are each defined in a first flange 254, which extends about a perimeter of the counterbore 252. In this example, the first chamber cover 230 also includes a fluid coupling 256.

The first, exterior surface 240 defines an exterior of the first chamber cover 230. The first, exterior surface 240 is opposite the second, interior surface 242. The supply inlet 106 is defined through the first, exterior surface 240 and the second, interior surface 242 so as to extend along an axis that is substantially oblique to the longitudinal axis L2 of the pump housing 200. The pump drive shaft receptacle 144 is substantially cylindrical, and includes the central bore 144*a* that is sized to receive the pump drive shaft 116. The pump drive shaft receptacle 144 is defined at a first end of the first chamber cover 230, which is opposite a second end of the first chamber cover 230.

Figure 8:
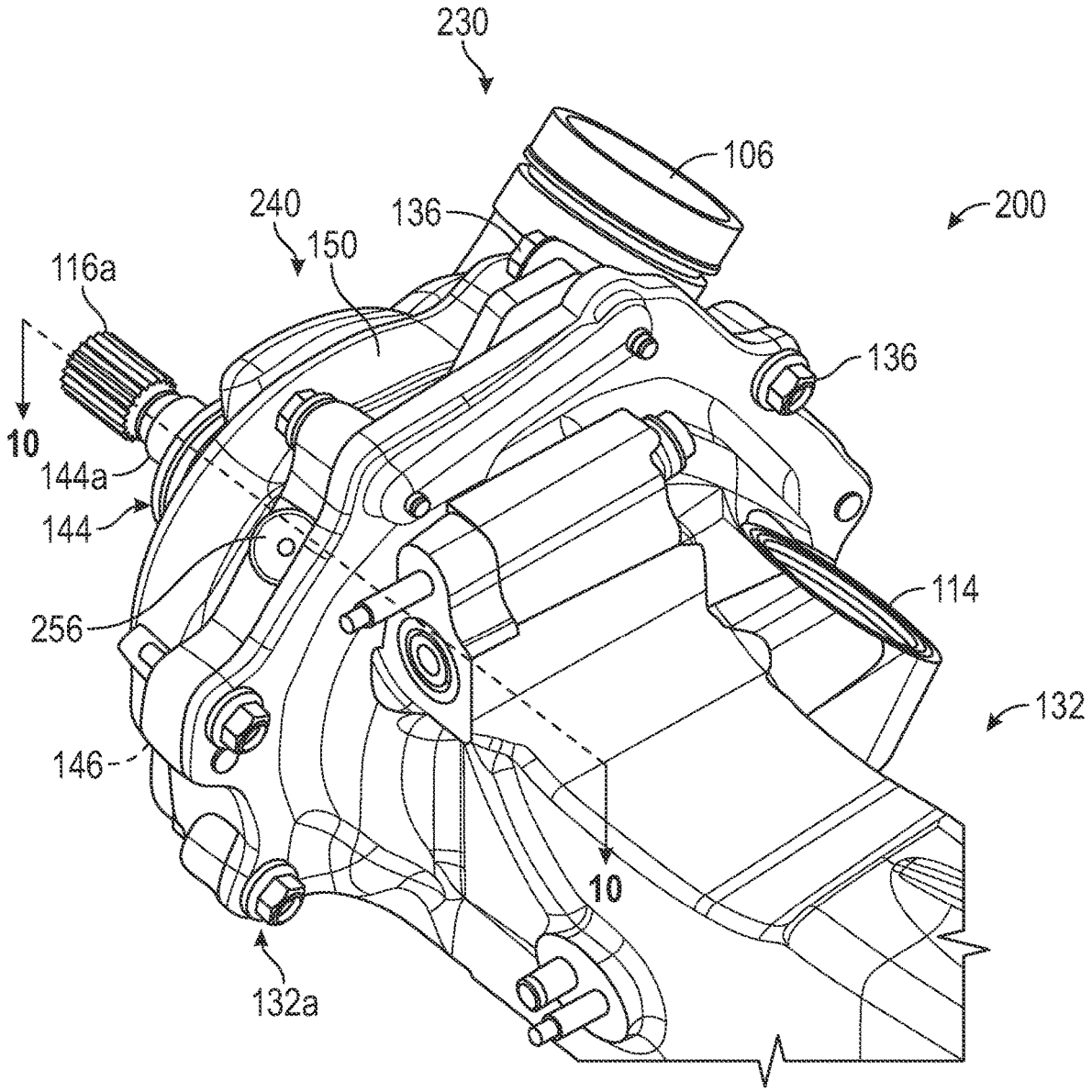
FIG. 8 is a detail perspective view of a first chamber cover and a first portion of a housing body of the pump housing of FIG. 7.

With reference to FIG. 9, the first flange 254 is integrally formed with the first chamber cover 230. Generally, the first flange 254 defines a mating surface, which is in contact with the housing body 132 when the first chamber cover 230 is coupled to the first portion 132*a* of the housing body 132. The first flange 254 is defined at the second end of the first chamber cover 230 so as to be substantially opposite the pump drive shaft receptacle 144. The plurality of coupling bores 146 are spaced apart about a perimeter of the first flange 254. The coupling bores 146 are defined through the first, exterior surface 240 and the second, interior surface 242 at the first flange 254. When the first chamber cover 230 is positioned adjacent to the first portion 132*a*, each of the coupling bores 146 is coaxially aligned with a respective bore defined through the first portion 132*a* (FIG. 8). Each of the coupling bores 146 is configured to receive a respective one of the mechanical fasteners 136 to couple the first chamber cover 230 to the first portion 132*a* of the housing body 132.

Figure 10:
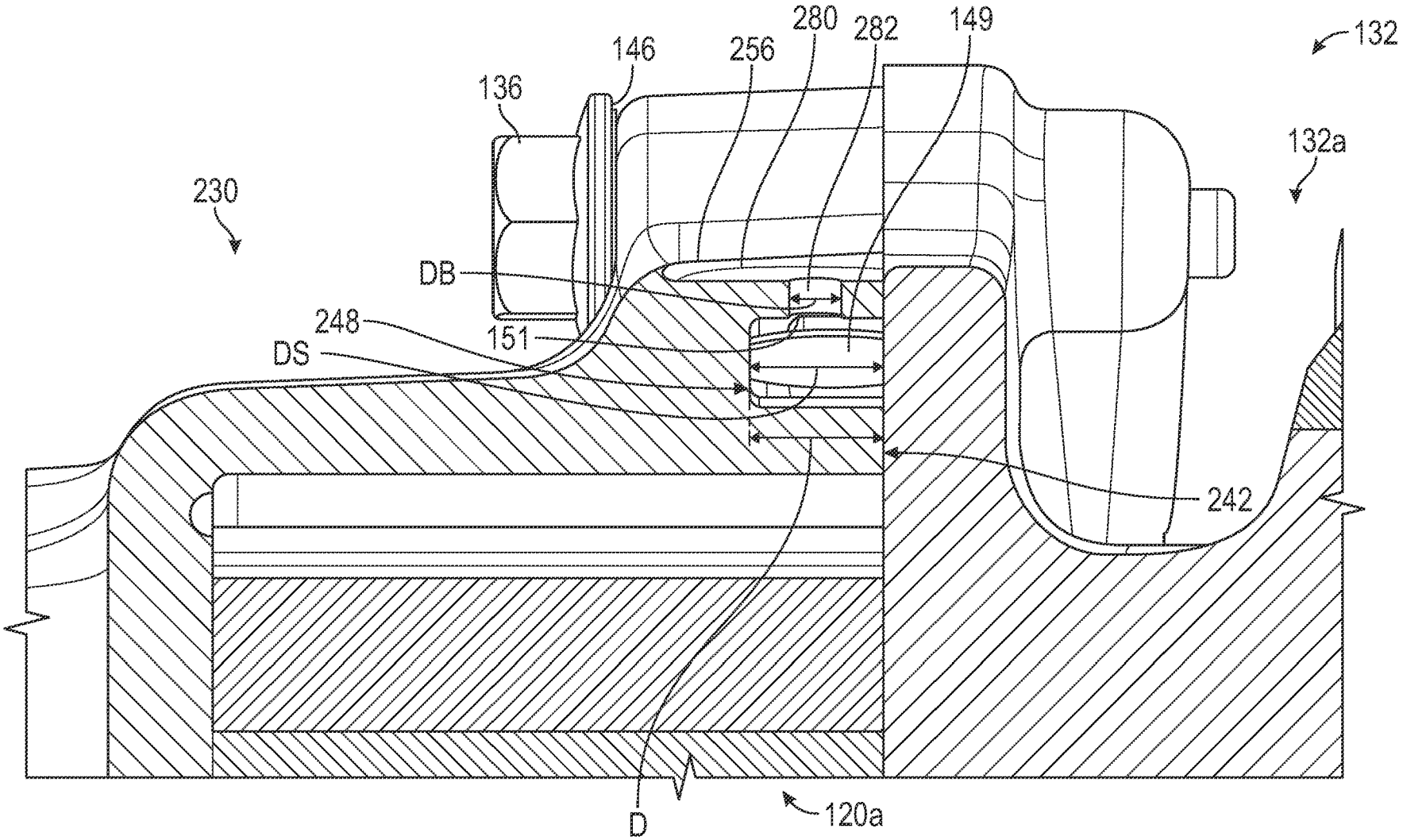
FIG. 10 is a cross-sectional view of the first chamber cover and the first portion of the housing body taken along line 10-10 of FIG. 8.

The sealing member groove 248 is defined into the second, interior surface 242 at the first flange 254 so as to extend about and substantially circumscribe a perimeter of the first chamber cover 230. With reference to FIG. 10, the sealing member groove 248 is defined axially into the second, interior surface 242 for the depth D, which is predetermined to enable receipt of the sealing member 149, such as a press-in-place elastomeric gasket. When the first chamber cover 230 is coupled to the first portion 132*a* of the housing body 132, the first chamber cover 230 and the first portion 132*a* cooperate to compress the sealing member 149, which substantially circumscribes the perimeter of the first chamber cover 230, to seal the first chamber cover 230 against the housing body 132. In one example, the sealing member groove 248 is defined in the second, interior surface 242 at the first flange 254 so as to surround the counterbore 252.

With reference back to FIG. 9, the counterbore 252 is defined at the second, interior surface 142 to extend axially inward from the second end to the first end of the first chamber cover 230. The counterbore 252 is sized and shaped to at least partially receive the first pump 102 and to couple the first pump 102 to the pump drive shaft 116 (FIG. 1).

In one example, the at least one drain 150 comprises the three drains 150*a*, 150*b*, 150*c*, which are slots defined in the second, interior surface 242 at the first flange 254. Each of the drains 150*a*, 150*b*, 150*c* is defined with the drain depth DP, which is about 40% to about 50% the depth D of the sealing member groove 248. By providing the drains 150*a*, 150*b*, 150*c* with the drain depth DP, the sealing member 149 remains seated within and retained by the sealing member groove 248 to maintain the seal between the first chamber cover 230 and the housing body 132 while enabling fluid, such as oil, trapped in the sealing member groove 248 to drain from the pump housing 200 prior to installation in the vehicle 10. In this example, each of the drains 150*a*, 150*b*, 150*c* are defined in the second, interior surface 242 to have the width W. The drains 150*a*, 150*b*, 150*c* are sized and shaped to enable the fluid or oil that may enter the sealing member groove 248 to drain from the first chamber cover 230 or to drain external to the pump housing 200 prior to installation in the vehicle 10. By draining the fluid or oil in the sealing member groove 248 prior to installation in the vehicle 10, the drains 150*a*, 150*b*, 150*c* ensure that any fluid accumulated in the pump housing 200 is removed prior to installation.

In this example, the three drains 150*a*, 150*b*, 150*c* are spaced apart about the perimeter of the first flange 254. Generally, at least one of the drains 150*a*, 150*b*, 150*c* is orientated to enable gravity to assist in drawing the fluid from the sealing member groove 248. The drain 150*a* is defined through the first flange 254 so as to be offset from the longitudinal axis L2 toward the supply inlet 106. The drain 150*b* is defined through the first flange 254 so as to be aligned with the supply inlet 106. The drain 150*c* is defined through the first flange 254 as to be aligned with the longitudinal axis L2 and circumferentially offset from the drain 150*a*.

The fluid coupling 256 is defined on the first, exterior surface 240 of the first flange 254. Generally, the fluid coupling 256 is defined on the first, exterior surface 240 so as to be inaccessible once the pump housing 200 is coupled to the propulsion system 20 and installed in the vehicle 10. The fluid coupling 256 is shaped and sized to enable a tool, such as a nozzle of a pneumatic hose, to be coupled to the first chamber cover 230 to direct or inject a purge fluid, such as pressurized air, into the sealing member groove 248. In one example, the fluid coupling 256 includes a contact surface 280 and a bore 282. The contact surface 280 is substantially semicircular, and is substantially planar or flat. The contact surface 280 is defined about a perimeter of the bore 282. The contact surface 280 enables the tool, such as the nozzle of the pneumatic hose, to be positioned flush against the contact surface 280 to ensure the purge fluid from the pneumatic hose is directed into the bore 282. The bore 282 is sized and shaped to be fluidly coupled to or in fluid communication with the tool, such as the nozzle of the pneumatic hose, to direct the purge fluid into the sealing member groove 248. In one example, with reference to FIG. 10, the bore 282 has a diameter DB, which is about 2.5 millimeters (mm). Generally, the diameter DB of the bore 282 is about 40% to about 45% of a cross-sectional diameter DS of the sealing member 149 in the installed state (with the first chamber cover 230 coupled to the housing body 132). Thus, the diameter DB of the bore 282 is different and less than the cross-sectional diameter of the sealing member 149 and also different and less than the depth D of the sealing member groove 248. Generally, the fluid coupling 256 is defined so that the bore 282 is not positioned directly adjacent to or aligned with the stabilizer 151 of the sealing member 149 to ensure that the purge fluid received from the bore 282 is able to flow through the sealing member groove 248. Stated another way, the bore 282 of the fluid coupling 256 is defined in the first flange 254 such that the stabilizer 151 does not block or impede the flow of the purge fluid directed through the bore 282.

As shown in FIG. 10, the bore 282 is defined through the first, exterior surface 240 so as to be fluidly coupled to the sealing member groove 248. By providing the first chamber cover 230 with the fluid coupling 256, the tool, such as the pneumatic hose, may be coupled to the fluid coupling 256 such that the nozzle is in fluid communication with the bore 282 to direct the purge fluid into the sealing member groove 248 to assist in draining fluid, such as oil, contained within the sealing member groove 248 through the drains 150*a*, 150*b*, 150*c* and out of the pump housing 200. Thus, the fluid coupling 256 cooperates with the drains 150*a*, 150*b*, 150*c* to drain the fluid or oil accumulated in the sealing member groove 248 from the first chamber cover 230 or to drain the accumulated fluid or oil external to the pump housing 200 prior to installation in the vehicle 10. It should be noted that in certain instances the drains 150*b*, 150*c* may be defined at slightly different locations to ensure that a flow path length from the fluid coupling 256 to each of the drains 150*b*, 150*c* is substantially the same.

Figure 11:
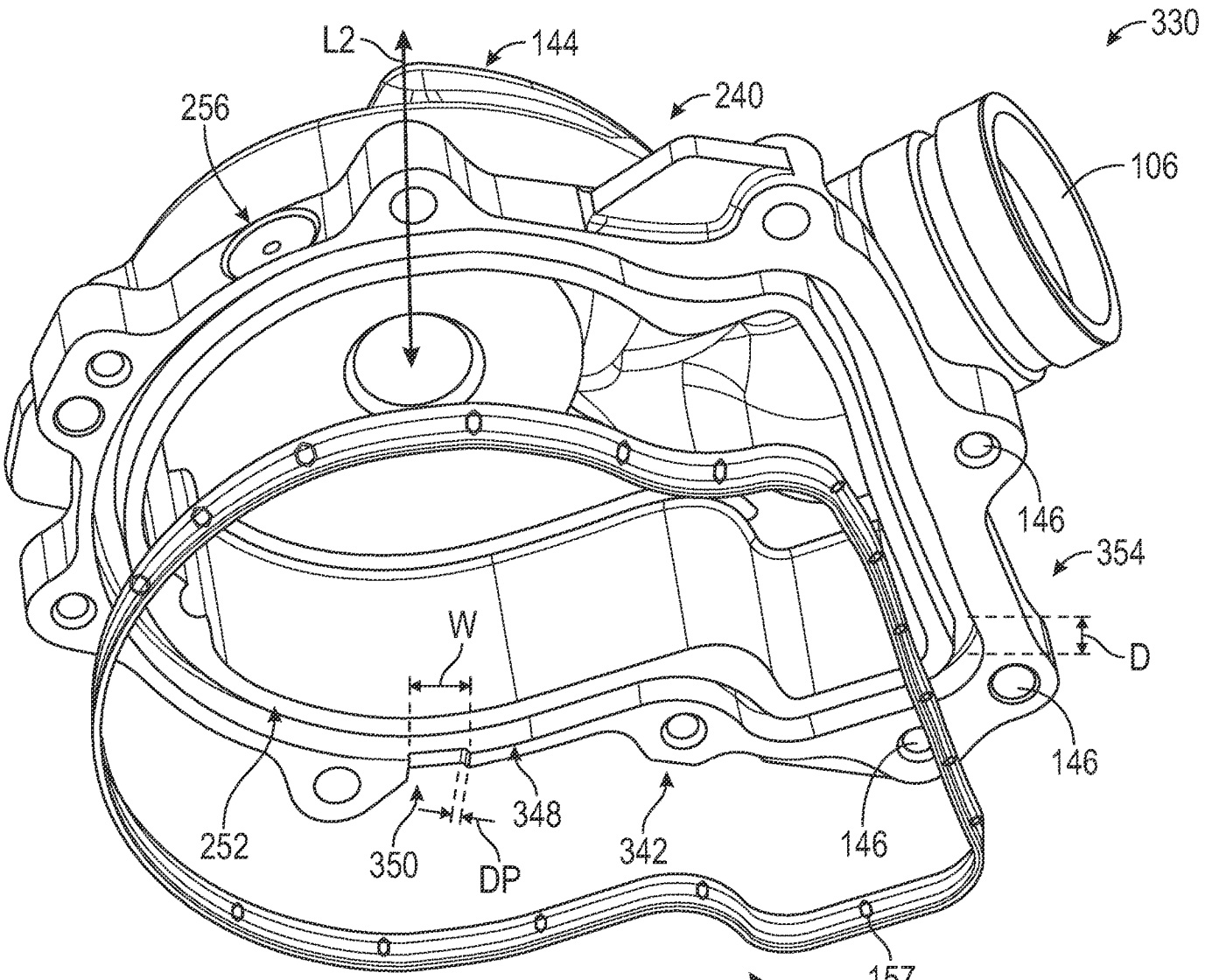
FIG. 11 is a perspective end view of another exemplary first chamber cover for the pump housing of FIG. 7 in accordance with various embodiments.

It should be noted that while the first chamber cover 230 is described herein as including the drains 150*a*, 150*b*, 150*c* to enable fluid or oil to drain from the sealing member groove 248 prior to installation in the vehicle 10, the first chamber cover 230 may be configured differently to enable the fluid or oil to drain from the pump housing 200. In one example, with reference to FIG. 11, a first chamber cover 330 is shown, which cooperates with the first portion 132*a* of the housing body 132 to define the first pump chamber 120*a*. As the first chamber cover 330 includes components that are the same or similar to components of the first chamber cover 330 discussed with regard to FIGS. 7-10, the same reference numerals will be used to denote the same or similar components. Generally, the first chamber cover 330 is composed of metal or metal alloy, and cast, machined, additively manufactured, etc. The first chamber cover 330 is removably coupled to the housing body 132. The first chamber cover 330 is removably coupled to the first portion 132*a* via the mechanical fasteners 136 to provide access to the first pump 102 for repair, maintenance, etc. In this example, the first chamber cover 330 includes the first, exterior surface 240, a second, interior surface 342, the supply inlet 106, the pump drive shaft receptacle 144, the plurality of coupling bores 146, a sealing member groove 348, at least one drain 350, and the counterbore 252. The coupling bores 146, the sealing member groove 348 and the at least one drain 350 are each defined in a first flange 354, which extends about a perimeter of the counterbore 252. In this example, the first chamber cover 330 also includes the fluid coupling 256.

The first, exterior surface 240 defines an exterior of the first chamber cover 330. The first, exterior surface 240 is opposite the second, interior surface 342. The supply inlet 106 is defined through the first, exterior surface 240 and the second, interior surface 342 so as to extend along an axis that is substantially oblique to the longitudinal axis L2 of the pump housing 200. The pump drive shaft receptacle 144 is substantially cylindrical, and includes the central bore 144*a* that is sized to receive the pump drive shaft 116. The pump drive shaft receptacle 144 is defined at a first end of the first chamber cover 330, which is opposite a second end of the first chamber cover 330.

With reference to FIG. 9, the first flange 354 is integrally formed with the first chamber cover 330. Generally, the first flange 354 defines a mating surface, which is in contact with the housing body 132 when the first chamber cover 330 is coupled to the first portion 132*a* of the housing body 132. The first flange 354 is defined at the second end of the first chamber cover 330 so as to be substantially opposite the pump drive shaft receptacle 144. The plurality of coupling bores 146 are spaced apart about a perimeter of the first flange 354. The coupling bores 146 are defined through the first, exterior surface 240 and the second, interior surface 342 at the first flange 354. When the first chamber cover 330 is positioned adjacent to the first portion 132*a*, each of the coupling bores 146 is coaxially aligned with a respective bore defined through the first portion 132*a* (FIG. 8). Each of the coupling bores 146 is configured to receive a respective one of the mechanical fasteners 136 to couple the first chamber cover 330 to the first portion 132*a* of the housing body 132.

The sealing member groove 348 is defined into the second, interior surface 342 at the first flange 354 so as to extend about and substantially circumscribe a perimeter of the first chamber cover 330. The sealing member groove 348 is defined axially into the second, interior surface 242 for the depth D, which is predetermined to enable receipt of the sealing member 149. When the first chamber cover 330 is coupled to the first portion 132*a* of the housing body 132, the first chamber cover 330 and the first portion 132*a* cooperate to compress the sealing member 149, which substantially circumscribes the perimeter of the first chamber cover 330, to seal the first chamber cover 330 against the housing body 132. In one example, the sealing member groove 348 is defined in the second, interior surface 342 at the first flange 354 so as to surround the counterbore 252.

In one example, the at least one drain 350 is a single slot that is defined in the second, interior surface 342 at the first flange 354. The drain 350 is defined with the drain depth DP, which is about 40% to about 50% the depth D of the sealing member groove 348. By providing the drain 350 with the drain depth DP, the sealing member 149 remains seated within and retained by the sealing member groove 348 to maintain the seal between the first chamber cover 330 and the housing body 132 while enabling fluid, such as oil, trapped in the sealing member groove 348 to drain from the pump housing 200 prior to installation in the vehicle 10. In this example, the drain 350 is defined in the second, interior surface 342 and has the width W. The width W of the drain 350 ensures that the stabilizer 151 associated with the sealing member 149 does not contact the drain 350. In addition, it should be noted that the width W of the drain 350 may taper such that the drain 350 may have a width at the sealing member groove 348 that is different and less than a width of the drain 350 at the first, exterior surface 340. The drain 350 is sized and shaped to enable the fluid or oil that may enter the sealing member groove 348 to drain from the first chamber cover 330 prior to installation in the vehicle 10. By draining the fluid or oil in the sealing member groove 348 prior to installation in the vehicle 10, the drain 350 ensures that any fluid accumulated in the pump housing 200 is removed prior to installation. In this example, the drain 350 is orientated to enable gravity to assist in drawing the fluid from the sealing member groove 348. The drain 350 is defined through the first flange 354 as to be aligned with the longitudinal axis L2. Generally, the drain 350 is defined on the first chamber cover 330 so as to be substantially opposite the fluid coupling 256. The drain 350 is orientated downward to enable gravity to assist in draining the fluid or oil during shipping.

The fluid coupling 256 is defined on the first, exterior surface 240 of the first flange 354. The fluid coupling 256 enables the tool to direct or inject the purge fluid, such as pressurized air, into the sealing member groove 348. The contact surface 280 is defined about a perimeter of the bore 282. The bore 282 is sized and shaped to be fluidly coupled to or in fluid communication with the tool to direct the purge fluid into the sealing member groove 348. The bore 282 is defined through the first, exterior surface 240 so as to be fluidly coupled to the sealing member groove 348. By providing the first chamber cover 330 with the fluid coupling 256, the tool, such as the pneumatic hose, may be coupled to the fluid coupling 256 such that the nozzle is in fluid communication with the bore 282 to direct the purge fluid into the sealing member groove 348 to assist in draining fluid, such as oil, contained within the sealing member groove 348 through the drain 350 and out of the pump housing 200. Thus, the fluid coupling 256 cooperates with the drain 350 to drain the fluid or oil accumulated in the sealing member groove 348 from the first chamber cover 330 or to drain the accumulated fluid or oil external to the pump housing 200 prior to installation in the vehicle 10.

With reference back to FIG. 7, as discussed, the housing body 132 includes the first portion 132*a* and the second portion 132*b*, which are fluidly isolated from each other. The first portion 132*a* is sized to at least partially receive the first pump 102, and includes the first pump outlet 110. The second portion 132*b* encloses the second pump 104. The second pump outlet 114 is defined in the second portion 132*b* so as to be proximate the first portion 132*a*, and the second inlets 112 are defined so as to be spaced apart from the second pump outlet 114. The second chamber cover 134 is removably coupled to the housing body 132 proximate the second inlets 112. The second chamber cover 134 is removably coupled to enable access to the second pump 104 for repair, maintenance, etc. It should be noted that while the pump housing 200 is described herein as including the second chamber cover 134 that includes the second drains 170*a*, 170*b*, in certain embodiments, the second chamber cover 134 may be devoid of or need not include the second drains 170*a*, 170*b*.

In one example, in order to couple the first pump 102 and the second pump 104 to the pump housing 100, 200, with the housing body 132 formed, the second pump 104 may be inserted into the housing body 132 of the pump housing 100, 200 such that respective gears of the second pump 104 are aligned with a respective one of the second inlets 112. With the second chamber cover 134 formed with the second drains 170*a*, 170*b*, the second chamber cover 134 is coupled to the second portion 132*b* of the housing body 132 to enclose the second pump 104. The first pump 102 is inserted into the first portion 132*a* of the housing body 132. With the first chamber cover 130, 230, 330 formed with the respective drains 150*a*, 150*b*, 150*c*, 350, the first chamber cover 130, 230, 330 is coupled to the first portion 132*a* of the housing body 132 via the mechanical fasteners 136.

Figure 7:
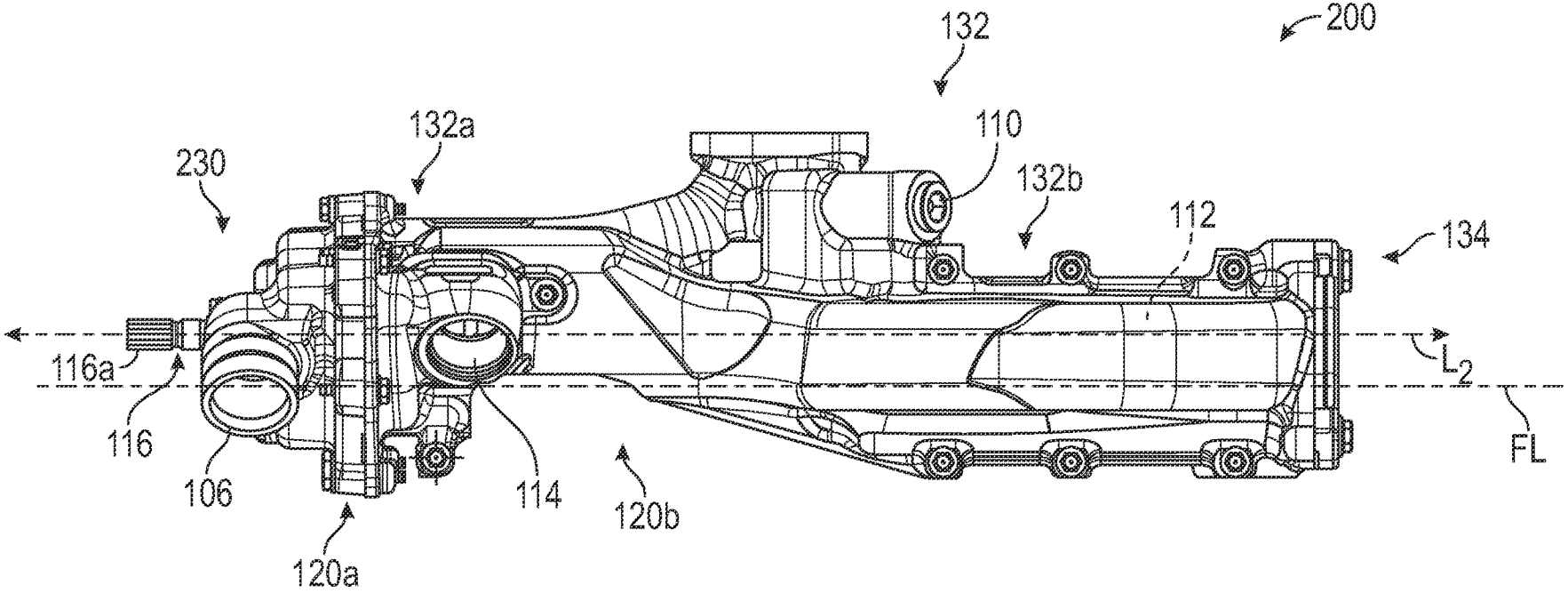
FIG. 7 is a front view of the pump housing in accordance with another exemplary embodiment, which encloses at least a portion of the first pump and the second pump associated with the vehicle in accordance with various embodiments.

With the pump housing 100, 200 assembled with the first pump 102 and the second pump 104 enclosed by the first chamber cover 130, 230, 330 and the second chamber cover 134, the pump housing 100, 200 with the first pump 102 and the second pump 104 may be tested prior to installation in the vehicle 10. In one example, in order to test the first pump 102, the second pump 104 and the pump housing 100, 200, the pump housing 100, 200 is submerged in a fluid, such as oil, such that the supply inlet 106 is at least partially disposed within the fluid in a test fixture. For example, the pump housing 100, 200 may be positioned such that the fluid reaches a fluid line FL as shown in FIGS. 2 and 7. A conduit may be coupled to the supply inlet 106 and disposed in the fluid so that the first pump 102 draws the fluid or oil into the first pump 102. It should be noted that the fluid line FL in FIGS. 2 and 7 may vary based on the fluid or oil employed.

With the pump housing 100, 200 disposed in the fluid or oil for testing, the fluid or oil may inadvertently enter the sealing member groove 148, 248, 348 of the first chamber cover 130, 230, 330. Once removed from the test fixture, the pump housing 100, 200, the first pump 102 and the second pump 104 may be packaged and transported for installation in the vehicle 10. In the example of the first chamber cover 130, the drains 150*a*, 150*b*, 150*c* cooperate with gravity to allow any fluid or oil accumulated within the sealing member groove 148 to drain from the pump housing 100 during the packaging and transporting of the pump housing 100, 200, the first pump 102 and the second pump 104 prior to installation in the vehicle 10. In the example of the first chamber cover 230, the tool is coupled to the fluid coupling 256 and actuated to supply or direct the purge fluid, such as pressurized air, into the sealing member groove 248. The purge fluid may flow through the sealing member groove 248 and expel the accumulated fluid or oil through the drains 150*a*, 150*b*, 150*c* to remove the oil from the pump housing 200 prior to installation in the vehicle 10. In the example of the first chamber cover 330, the tool is coupled to the fluid coupling 256 and actuated to supply or direct the purge fluid, such as pressurized air, into the sealing member groove 348. The purge fluid may flow through the sealing member groove 348 and expel the accumulated fluid or oil through the drain 350 to remove the oil from the pump housing 200 prior to installation in the vehicle 10. The second drains 170*a*, 170*b* also cooperate with gravity to allow the accumulated fluid or oil within the second sealing member groove 168 to drain from the pump housing 100 during the packaging and transporting of the pump housing 100, 200, the first pump 102 and the second pump 104 prior to installation in the vehicle 10.

By providing the pump housing 100, 200 with the drains 150*a*, 150*b*, 150*c*, 350, 170*a*, 170*b* the fluid or oil may be removed from the pump housing 100, 200 prior to installation in the vehicle 10. This ensures that any fluid or oil contained within the sealing member groove 148, 248, 348, 168 is removed prior to installation in the vehicle 10, which ensures that any accumulated fluid or oil does not exit the pump housing 100, 200 once installed. This improves owner satisfaction. Generally, the drains 150*a*, 150*b*, 150*c*, 350, 170*a*, 170*b* ensure that fluid or oil in contact with the sealing members that are not accessible upon assembly of the pump housing 100, 200 or the sealing members that are internal to the pump housing 100, 200 may be removed passively or actively without disassembly of the pump housing 100, 200. In addition, by positioning the fluid coupling 256 such that it is inaccessible once the pump housing 200 is coupled to the propulsion system 20, the fluid coupling 256 may not be inadvertently accessed by service personnel. In addition, it should be noted that while the drains 150*a*, 150*b*, 150*c*, 350, 170*a*, 170*b* are described and illustrated as comprising slots, one or more of the drains 150*a*, 150*b*, 150*c*, 350, 170*a*, 170*b* may comprise holes that fluidly couple the sealing member groove 148, 248, 348, 168 to the exterior of the pump housing 100, 200. Further, it should be noted that the position and orientation of the drains 150*a*, 150*b*, 150*c*, 350, 170*a*, 170*b* described and illustrated herein is merely an example, as the drains 150*a*, 150*b*, 150*c*, 350, 170*a*, 170*b* may be positioned and orientated differently based on the shape of the chamber cover 130, 230, 330, 134. In addition, it should be noted that if condensation or other water drawn into the sealing member groove 148, 248, 348, 168, the drains 150*a*, 150*b*, 150*c*, 350, 170*a*, 170*b* would also enable that condensation or other water to exit or be released from the pump housing 100, 200. For example, water may be drawn into the metal-to-metal joint defined between the first chamber cover 130, 230, 330 and/or second chamber cover 134 as temperature of the pump housing 100, 200 goes up and down due to the changes in temperature of the fluid or oil. Water may also be drawn into the joint defined between the first chamber cover 130, 230, 330 and/or second chamber cover 134 as temperature of the pump housing 100, 200 itself changes.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A pump housing associated with a vehicle, comprising:

a housing body that at least partially defines a pump chamber, the pump chamber configured to at least partially receive a pump;

a chamber cover configured to be removably coupled to the housing body, the chamber cover including a mating surface that is configured to contact the housing body when the chamber cover is coupled to the housing body, the mating surface defining a sealing member groove spaced apart from an exterior surface of the chamber cover and a drain configured to fluidly couple the sealing member groove with the exterior surface, the sealing member groove has a depth and the drain has a drain depth that is 45% or less of the depth of the sealing member groove; and wherein the drain is adjacent to the housing body.

2. The pump housing of claim 1, wherein the drain is a slot defined through the mating surface.

3. The pump housing of claim 1, wherein the drain comprises a plurality of drain slots that are spaced apart about a perimeter of the mating surface.

4. The pump housing of claim 1, wherein the exterior surface is fluidly coupled to the sealing member groove.

5. The pump housing of claim 4, wherein the exterior surface includes a contact surface that surrounds a bore, and the bore is defined between the exterior surface and the sealing member groove.

6. The pump housing of claim 5, wherein the bore has a diameter that is less than the depth of the sealing member groove.

7. The pump housing of claim 4, wherein the drain is defined on the chamber cover so as to be substantially opposite the contact surface that surrounds the bore.

8. The pump housing of claim 1, wherein the pump housing is coupled externally to a propulsion system an engine of the vehicle.

9. A pump housing associated with a vehicle, comprising:

a housing body that at least partially defines a pump chamber, the pump chamber configured to at least partially receive a pump;

a chamber cover configured to be removably coupled to the housing body, the chamber cover including a mating surface that is configured to contact the housing body when the chamber cover is coupled to the housing body, the mating surface defining a sealing member groove spaced apart from an exterior surface of the chamber cover and a drain configured to fluidly couple the sealing member groove with the exterior surface, the sealing member groove has a depth and the drain has a drain depth that is 45% or less of the depth of the sealing member groove; and wherein the housing body at least partially defines the pump chamber and a second pump chamber, a second chamber cover is configured to be removably coupled to the second pump chamber and the second chamber cover includes a second mating surface that defines a second sealing member groove that is spaced apart from a second exterior surface of the second chamber cover, and the second mating surface is configured to contact the housing body.

10. The pump housing of claim 9, wherein the second mating surface defines a second drain that is configured to fluidly couple the second sealing member groove with the second exterior surface.

11. A vehicle, comprising:

an engine;

a pump configured to be fluidly coupled to the engine to supply the engine with a fluid; and a pump housing configured to be externally coupled to the engine, the pump housing including a housing body that at least partially defines a pump chamber to at least partially receive the pump and a chamber cover configured to be removably coupled to the housing body, the chamber cover including a mating surface that defines a sealing member groove that is spaced apart from an exterior surface of the chamber cover and a drain configured to fluidly couple the sealing member groove with the exterior surface, the sealing member groove has a depth and the drain has a drain depth that is 45% or less of the depth of the sealing member groove, and wherein the drain is defined on the chamber cover adjacent the housing body.

12. The vehicle of claim 11, wherein the drain is a slot defined through the mating surface.

13. The vehicle of claim 12, wherein the drain comprises a plurality of drain slots that are spaced apart about a perimeter of the mating surface.

14. The vehicle of claim 11, wherein the housing body at least partially defines the pump chamber and a second pump chamber, a second chamber cover is configured to be removably coupled to the second pump chamber and the second chamber cover includes a second mating surface that defines a second sealing member groove that is spaced apart from a second exterior surface of the second chamber cover, and the second mating surface is configured to contact the housing body.

15. The vehicle of claim 14, wherein the second mating surface defines a second drain that is configured to fluidly couple the second sealing member groove with the second exterior surface.

16. The vehicle of claim 15, wherein the second drain comprises a plurality of second drains, and each of the plurality of second drains is a slot defined through the second mating surface.

17. The vehicle of claim 11, wherein the chamber cover includes the exterior surface and is fluidly coupled to the sealing member groove.

18. The vehicle of claim 17, wherein the exterior surface includes a contact surface that surrounds a bore, and the bore is defined between the exterior surface and the sealing member groove.

19. The vehicle of claim 18, wherein the bore has a diameter that is less than a cross-sectional diameter of a sealing member coupled to the sealing member groove.

20. The vehicle of claim 17, wherein the drain is substantially opposite the coupling contact surface that surrounds the bore.

* * * * *